US010856682B2

(12) United States Patent
Green

(10) Patent No.: US 10,856,682 B2
(45) Date of Patent: Dec. 8, 2020

(54) AROMA ENHANCING BEVERAGE CONTAINERS AND LIDS

(71) Applicant: Marie Green, Brentwood, TN (US)

(72) Inventor: Marie Green, Brentwood, TN (US)

( * ) Notice: Subject to any disclaimer, the term of this patent is extended or adjusted under 35 U.S.C. 154(b) by 62 days.

(21) Appl. No.: 16/259,885

(22) Filed: Jan. 28, 2019

(65) Prior Publication Data

US 2019/0150643 A1 May 23, 2019

Related U.S. Application Data

(63) Continuation of application No. 15/288,591, filed on Oct. 7, 2016, now Pat. No. 10,226,142, which is a continuation-in-part of application No. 14/804,275, filed on Jul. 20, 2015, now Pat. No. 9,603,471.

(60) Provisional application No. 62/293,721, filed on Feb. 10, 2016, provisional application No. 62/026,484, filed on Jul. 18, 2014.

(51) Int. Cl.
*A47G 19/22* (2006.01)

(52) U.S. Cl.
CPC ..... *A47G 19/2272* (2013.01); *A47G 2400/04* (2013.01)

(58) Field of Classification Search
CPC ..... A47G 19/2272; A47G 19/2266; A47G 19/2205; B65D 43/0204; B65D 43/0212; B65D 43/0214; B65D 43/0218; B65D 43/0222; B65D 43/02
USPC ..... 220/713, 711, 703, 287, 795, 780, 781, 220/802, 796, 367.1, 366.1; 229/404, 400
See application file for complete search history.

(56) References Cited

U.S. PATENT DOCUMENTS

| | | | | |
|---|---|---|---|---|
| 3,065,875 | A | 11/1962 | Negoro | |
| 4,113,135 | A | 9/1978 | Yamazaki | |
| 4,138,033 | A | 2/1979 | Payne et al. | |
| 4,415,097 | A | 11/1983 | Meins | |
| 4,609,113 | A | 9/1986 | Seki | |
| 4,619,372 | A | 10/1986 | McFarland | |
| 4,767,019 | A * | 8/1988 | Horner | B65D 47/06 220/713 |
| 5,911,331 | A | 6/1999 | Boller | |
| 6,076,450 | A | 6/2000 | DiGiorgio, Jr. | |
| 6,164,485 | A | 12/2000 | Hilton | |

(Continued)

FOREIGN PATENT DOCUMENTS

| | | | |
|---|---|---|---|
| CA | 2677938 A1 | 12/2010 | |
| CA | 2954254 A1 | 2/2015 | |
| WO | WO-2012173869 A1 * | 12/2012 | A47G 19/2272 |

OTHER PUBLICATIONS

FoamAroma Web Pages; retrieved from www.foamaroma.com on Jul. 9, 2014, 16 pages (2011).

(Continued)

*Primary Examiner* — Robert J Hicks
(74) *Attorney, Agent, or Firm* — Eric B. Fugett; Mark A. Pitchford; Pitchford Fugett, PLLC

(57) ABSTRACT

A lid for a beverage container can include a cover member configured to releasably engage the opening of a beverage container. The cover member can include an aroma aperture defined through a portion thereof, the aroma aperture sized and shaped to receive the nose of a user when the lid is engaged with the opening of the beverage container and the user drinks a beverage contained in the beverage container through the lid.

20 Claims, 13 Drawing Sheets

(56) References Cited

U.S. PATENT DOCUMENTS

| | | | | |
|---|---|---|---|---|
| 6,207,100 | B1 * | 3/2001 | Weiss | B29C 51/32 220/366.1 |
| 6,302,268 | B1 | 10/2001 | Michaeli | |
| D449,986 | S | 11/2001 | Schaefer | |
| 6,357,619 | B1 | 3/2002 | Schaefer | |
| 6,578,726 | B1 | 6/2003 | Schaefer | |
| D480,968 | S | 10/2003 | Atkins et al. | |
| 6,889,859 | B1 | 5/2005 | Leon | |
| D518,996 | S | 4/2006 | Schmidt | |
| 7,111,749 | B1 | 9/2006 | Akers | |
| 7,191,911 | B2 | 3/2007 | O'Neill | |
| 7,959,028 | B2 * | 6/2011 | Leon | B65D 43/0204 220/717 |
| 7,959,029 | B2 * | 6/2011 | Whitaker | B65D 43/0212 220/719 |
| 8,056,752 | B2 | 11/2011 | Carnevali | |
| 8,167,162 | B2 | 5/2012 | Levey | |
| 8,313,002 | B2 | 11/2012 | Tokunaga | |
| 8,496,983 | B2 | 7/2013 | Michaeli et al. | |
| D722,498 | S | 2/2015 | Fleming | |
| 8,950,623 | B2 | 2/2015 | Fleming | |
| D737,142 | S | 8/2015 | Brannock | |
| D739,729 | S | 9/2015 | Brannock | |
| D756,773 | S | 5/2016 | Brannock | |
| 2004/0089662 | A1 | 5/2004 | Smith et al. | |
| 2005/0092759 | A1 | 5/2005 | Willat | |
| 2006/0169707 | A1 | 8/2006 | Walz | |
| 2006/0255037 | A1 * | 11/2006 | Hollis | B65D 47/10 220/254.3 |
| 2007/0095832 | A1 * | 5/2007 | Hollis | B65D 47/10 220/254.5 |
| 2008/0000921 | A1 * | 1/2008 | Leon | B65D 43/0204 220/713 |
| 2009/0050641 | A1 * | 2/2009 | Ivey | B65D 43/0222 220/713 |
| 2009/0250479 | A1 | 10/2009 | Kaufman et al. | |
| 2009/0266829 | A1 | 10/2009 | Bailey | |
| 2009/0283526 | A1 | 11/2009 | Pierce et al. | |
| 2010/0301048 | A1 | 12/2010 | Tokunaga | |
| 2011/0114655 | A1 | 5/2011 | Bailey | |
| 2011/0155732 | A1 | 6/2011 | Sprunger | |
| 2011/0174658 | A1 | 7/2011 | Otsubo | |
| 2011/0303678 | A1 | 12/2011 | Zomorodi et al. | |
| 2012/0152968 | A1 | 6/2012 | Bailey | |
| 2012/0199584 | A1 | 8/2012 | Pensak | |
| 2013/0020338 | A1 | 1/2013 | French et al. | |
| 2014/0042177 | A1 | 2/2014 | Fleming | |
| 2014/0042178 | A1 | 2/2014 | Brannock | |
| 2014/0203025 | A1 * | 7/2014 | Riggan | A47G 19/30 220/575 |
| 2015/0014322 | A1 * | 1/2015 | Kim | B65D 51/18 220/373 |
| 2015/0031516 | A1 * | 1/2015 | Brannock | B65D 47/06 493/87 |
| 2015/0216342 | A1 * | 8/2015 | Tabor | B65D 43/02 220/254.3 |
| 2016/0075492 | A1 | 3/2016 | Brannock | |
| 2016/0345762 | A1 | 12/2016 | Brannock | |

OTHER PUBLICATIONS

Koziol Insulated Cup Aroma To Go Product Reference, retrieved from http://www.amazon.com/Koziol-Insulated-Aroma-Orange-Hand/dp/B0073LRJQ2/ref=sr_1_3?ie=UTF8&qid=1437524088&sr=8-3&keywords=koziol+aroma+cup on Jul. 21, 2015, 5 pages (2013).

International Search Report, PCT Application PCT/US2015/041205, dated Nov. 10, 2015, 6 pages.

Written Opinion, PCT Application PCT/US2015/041205, dated Nov. 10, 2015, 7 pages.

* cited by examiner

AROMA ENHANCING BEVERAGE CONTAINERS AND LIDS

CROSS-REFERENCES TO RELATED APPLICATIONS

This application is a continuation of U.S. patent application Ser. No. 15/288,591, filed Oct. 7, 2016 and titled "Aroma Enhancing Beverage Containers and Lids," which claims the benefit of U.S. Provisional Patent Application No. 62/293,721, filed Feb. 10, 2016 and titled "Beverage Lid with Aroma Catching Canopy for Nose," and which is a continuation-in-part of U.S. patent application Ser. No. 14/804,275, filed Jul. 20, 2015 and titled "Beverage Lid Cover for Enhancing Aroma," which claims priority to U.S. Provisional Application No. 62/026,484, filed Jul. 18, 2014, the contents of all of which applications are incorporated herein in their entirety by this reference A portion of the disclosure of this patent document contains material that is subject to copyright protection. The copyright owner has no objection to the reproduction of the patent document or the patent disclosure, as it appears in the U.S. Patent and Trademark Office patent file or records, but otherwise reserves all copyright rights whatsoever.

BACKGROUND

The present disclosure relates generally to beverage containers and lids for beverage containers, and more particularly to beverage containers and lids that cover a portion of the nose to provide a user with improved aroma perception and spill protection.

People consume hot aromatic beverages and other liquid foodstuffs, such as tea, coffee, and soups, in many different settings throughout the day all across the world. In recent years, the global market for aromatic beverages alone has grown to account for almost one-third of the volume of global beverage consumption. For example, more than half of Americans over the age of 18 currently drink at least one cup of coffee a day. The demand for high quality hot aromatic beverages is expected to continue to grow as high quality branded specialty coffee and tea products gain greater market presence.

The demand for specialty beverage products is already so great that the enjoyment of the olfactory and visual aspects of such beverages has become ritualized in modernized countries around the world. Many aromatic beverage enthusiasts even view the aroma of such beverages as equally important, if not more so, than the taste because the aroma of a beverage provides more sensory information, and thus a fuller and richer tasting experience. Accordingly, just as the demand for aromatic beverages has grown and is expected to grow further, so too is the degree to which consumers discriminate between competing beverage products using a multi-modal sensory perception rather than traditional economic factors.

Consumers of hot aromatic beverages are known to prefer to drink such beverages from conventional open-top beverage containers, such as cups, mugs, thermoses, glasses, bottles, bowls, and other drinking vessels having a large central opening defined by a rim extending generally upwardly from a base, because open-top containers provide a more enjoyable sensory experience than do traditional lidded and closed-top containers by directly exposing a user to aroma vapors evolved from a beverage and allowing the user to easily see and control the amount of beverage consumed with each sip.

By contrast, conventional closed-top containers and lids such as lidded or capped disposable cups, travel mugs, bottles, cans, and thermoses, are typically provided with a small hole through which a user drinks and are reserved almost exclusively for on-the-go use because such containers and lids dramatically limit a user's exposure to desirable aroma vapors evolved from the beverage. For example, a person drinking a hot beverage from a lidded disposable cup will typically only be able to perceive one or two of the basic gustatory tastes, such as sweet or bitter, because the lid severely limits or prevents aroma vapors and odor molecules evolved by the beverage from reaching the person's olfactory receptors, which are responsible for the detection and appreciation of aroma. As a result, the person is unable to fully perceive or appreciate the full range of flavors of the drink, making the drink taste more bland than it actually is. In fact, the person may even smell the constituent material from which the lid or beverage container is formed—usually a type of synthetic polymer plastic—instead. While some conventional lids may include a pinhole or other aperture to vent steam, these openings are not sufficient to facilitate perception of aroma by a user as they cause what little aroma may escape to quickly dissipate into the ambient air.

Many traditional closed-top containers and lids also do not provide sufficient space for a user to place the nose while drinking. For example, some lids can have a shallow indentation designed to accommodate a small portion of the tip of a user's nose during each sip. The vast majority of lids, however, have a generally flat surface. In either case, such lids force the user to tilt their entire head further and further back as more liquid is consumed in order to finish the liquid at the bottom of the container. This is not only uncomfortable for the user, but can cause unpleasant or even dangerous results since hot liquids can spill or leak onto the user's clothing and body.

Further, the necessary motion of leaning the head back can cause a user to look away from where they are going while walking or driving, which can lead to very unsafe situations and injure the user or others. Lids provided with a small hole through which a user drinks can also allow hot liquid to flow into the user's mouth with little if any control, and block a user's line of sight to the beverage surface, making it difficult to drink safely or enjoy desirable beverage aromas.

What is needed then are improvement in beverage containers and lids for beverage containers.

BRIEF SUMMARY

The present disclosure overcomes some or all of the above-identified deficiencies of the prior art, as will become evident to those of ordinary skill in the art after a study of the information provided in this document. This brief summary is provided to introduce a selection of concepts in a simplified form that are further described below in the Detailed Description. This summary is not intended to identify key features or essential features of the claimed subject matter, nor it is intended to be used as an aid in determining the scope of the claims subject matter.

Accordingly, in one aspect, the disclosure provides an aroma enhancing lid for a beverage container having an opening defined by a rim. The lid can comprise a cover member configured to releasably engage the opening of a beverage container, and an aroma aperture defined through a portion of the cover member. The aroma aperture can be sized and shaped to receive the nose of a user when the lid is engaged with the opening of the beverage container and the user drinks a beverage contained in the beverage container through the lid.

In another aspect, the disclosure provides an aroma enhancing beverage container for enhancing the aroma of a liquid foodstuff contained therein. The beverage container can comprise a body portion adapted to be held in a hand of a user, the body portion including a base and a side wall extending generally upward from the base to form a rim at a first height above the base, a convex canopy extending generally upwardly along a curvature of the canopy from the rim to an apex at a second height above the first height, and an aroma aperture defined though a portion of the canopy portion, the aperture sized and shaped to receive the nose of a user when the user drinks a liquid foodstuff contained in the body portion through the aperture.

One objective of the present disclosure is to focus desirable aroma vapors evolved by a beverage or liquid foodstuff into the nose of a user for improved flavor perception and a richer tasting experience. Another objective is to have a user's nose extend through an aroma aperture defined through a beverage container or lid to access desirable aroma vapors concentrated in an interior space defined by the container or lid. Yet another objective is to prevent or minimize contact between the nose of a user and an upper surface of a beverage container lid without blocking the line of sight of the user to his or her surroundings. Still another objective is to reduce the degree of head tilt and stress placed on the neck of a user while drinking. Still yet another objective is to allow the user to see the beverage or other liquid foodstuff while drinking.

Numerous other objects, advantages and features of the present disclosure will be readily apparent to those of skill in the art upon a review of the following drawings and description of a preferred embodiment.

DETAILED DESCRIPTION

Figure 1:
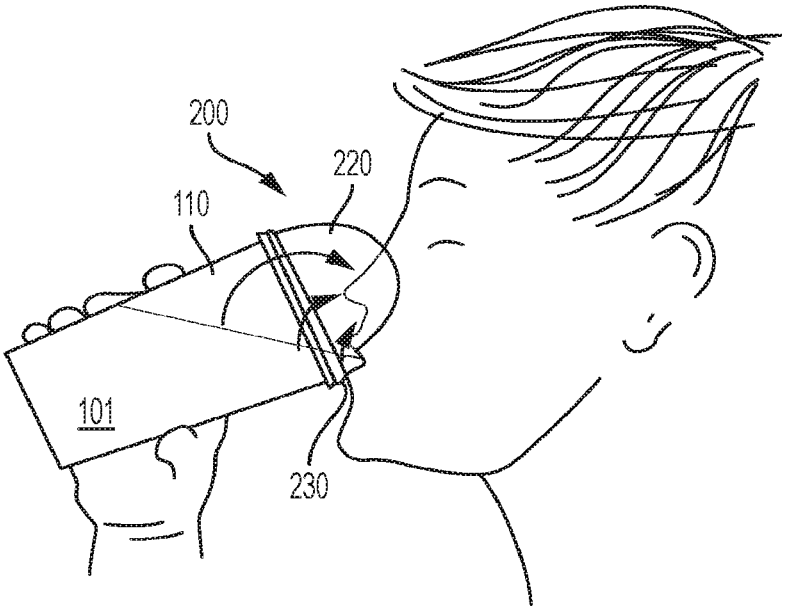
FIG. 1 shows a user drinking a beverage contained in a conventional beverage container through an embodiment of an aroma enhancing beverage container lid constructed in accordance with an aspect of the present disclosure.

The details of one or more embodiments of the presently disclosed subject matter are set forth in this document. Modifications to embodiments described in this document, and other embodiments, will be evident to those of ordinary skill in the art after a study of the information provided herein. The information provided in this document, and particularly the specific details of the described exemplary embodiments, is provided primarily for clearness of understanding and no unnecessary limitations are to be understood therefrom. In case of conflict, the specification of this document, including definitions, will control.

While the terms used herein are believed to be well understood by one of ordinary skill in the art, definitions are set forth herein to facilitate explanation of the subject matter disclosed herein.

Unless defined otherwise, all technical, geometric, scientific, and medical terms used herein have the same meaning as commonly understood by one of ordinary skill in the art to which the subject matter disclosed herein belongs. Although any methods, devices, and materials similar or equivalent to those described herein can be used in the practice of the presently disclosed subject matter, representative methods, devices, and materials are now described.

The terms "a", "an", and "the" refer to "one or more" when used in this application, including the claims. Thus, for example, reference to "a scent" includes a plurality of scents, and so forth. The use of the word "a" or "an" when used in conjunction with the term "comprising" in the claims and/or the specification may mean "one," but it is also consistent with the meaning of "one or more," "at least one," and "one or more than one."

All references to singular characteristics or limitations of the present disclosure shall include the corresponding plural characteristic(s) or limitation(s) and vice versa, unless otherwise specified or clearly implied to the contrary by the context in which the reference is made.

The methods and devices of the present disclosure, including components thereof, can comprise, consist of, or consist essentially of the essential elements and limitations of the embodiments described herein, as well as any additional or optional components or limitations described herein or otherwise useful.

Unless otherwise indicated, all numbers expressing physical dimensions, relative sizes, and so forth used in the specification and claims are to be understood as being modified in all instances by the term "about". Accordingly, unless indicated to the contrary, the numerical parameters set forth in this specification and claims are approximations that can vary depending upon the desired properties sought to be obtained by the presently disclosed subject matter. For example, as used herein, the term "about," when referring to a value for a physical dimension such as height, length, width, diameter, radius, circumference, or an angle is meant to encompass variations of in some embodiments ±20%, in some embodiments ±10%, in some embodiments ±5%, and in some embodiments ±1% from the specified value, as such variations are appropriate to perform the disclosed method or to achieve the disclosed result.

As used herein, ranges can be expressed as from "about" one particular value, and/or to "about" another particular value. It is also understood that there are a number of values disclosed herein, and that each value is also herein disclosed as "about" that particular value in addition to the value itself. For example, if the value "10" is disclosed, then "about 10" is also disclosed. It is also understood that each unit between two particular units are also disclosed. For example, if 10 and 15 are disclosed, then 11, 12, 13, and 14 are also disclosed. It should be similarly understood that fractional value between two particular values involving a non-whole number are also disclosed. For example, if 1.2 and 1.6 are disclosed, then 1.1, 1.2, 1.3, 1.4, and 1.5 are also disclosed.

The terms "conventional beverage container" and "traditional beverage container" as used synonymously herein refer to common hand held drinking vessels and other containers for holding beverages and other liquid foodstuffs intended to be consumed by a human therefrom, including without limitation cups, mugs, tumblers, glasses, thermos, cans, bottles, bowls, and other similar devices having a base and one or more side walls extending generally upwardly from the base to form a rim at a height above the base. The term "open-top beverage container" refers to a conventional beverage container having a large central opening defined by a rim, such as a cup, mug, or glass. The terms "closed-top" and "lidded" refer to open-top beverage containers the central opening of which is partially or completely covered by a lid or cap, such as a disposable coffee cup fitted with a conventional plastic lid.

The terms "drink" and "drinks," when used as verbs herein, refer to the action of placing the lips on a portion of a container, or a lid connected to the container, and taking a liquid contained in the container directly into the mouth without the aid of a straw.

Turning now to FIGS. 1 and 13A through 16C, there are shown different embodiments of aroma enhancing beverage container lids 200 constructed in accordance with an aspect of the present disclosure. A lid 200 can be a cover member 200 configured to releasably engage the opening of a conventional beverage container 110. The cover member 200 can include a cover portion 220 coupled to a mounting portion 230 configured to releasably engage the rim 116 of the beverage container 110, as shown in FIGS. 7 through 12B. The cover portion 220 can be configured to receive and cover a portion of the nose of a user, and to direct aroma vapors (depicted by arrows in FIG. 1) evolved by a hot aromatic beverage or other liquid foodstuff 101 contained in the beverage container 110 to the nose while the user drinks the beverage 101 through the lid 200.

The mounting portion 230 can be shaped and sized to fit over and releasably connect to the rim 116 of a traditional beverage container 110 using means known in the art. For example, in some implementations, the mounting portion 230 can elastically stretch to fit over the rim 116 of the beverage container 110 and then elastically contract to its original size to couple against an outside surface of the rim 116 of the beverage container 110. In other implementations, the mounting portion 230 can include one or more mechanical fasteners to releasably connect the lid to the rim 116 of a beverage container 110, including without limitation a clasp, hook, snap connectors, screw threads, or the like.

In some embodiments, the mounting portion 230 can have a sealing inside surface that mates with the rim 116 of a traditional beverage container 110 to create a leak-proof seal when the mounting portion 230 is engaged with the beverage container 110, so that when a user drinks a beverage 101 contained in the beverage container through the lid 200, the beverage 101 will not leak from the rim 116. For example, in some embodiments, the mounting portion 230 can include a sealing groove or ridge 235 which frictionally engages the rim 116 of the beverage container 110 to form a leak-proof seal between an inner surface of the mounting portion 230 and the rim 116 of the beverage container 110. In other embodiments, the mounting portion 230 can include a sealing member such as a rubber O-ring to form a seal with the rim 116.

The mounting portion 230 can take any shape complimentary to that of the rim 116 of a conventional beverage container 110, including without limitation, annular, rectangular, square, triangular, ovoid, polygonal, and irregular shapes, as long as it is shaped and sized to fit over the opening of the beverage container 110 such that the mounting portion 230 releasably engages the rim 116 of the beverage container 110. For example, the mounting portion 230 of an aroma enhancing beverage container lid 200 configured to releasably engage a circular beverage container rim 116 can be annular.

The cover portion 220 can form a canopy 222 that spans at least a portion of the opening of the beverage container 110. The canopy 222 can define a first interior space in fluid communication with a second interior space defined by the beverage container 110. Aroma vapors (depicted by arrows in FIG. 1) evolved from an aromatic beverage 101 contained in the second interior space can rise from the beverage 101 into the first interior space defined by the canopy 222 where they are contained and concentrated by the walls of the canopy 222.

An aroma enhancing lid 200 can also include an aroma aperture 225 extending from an exterior surface of the lid to an interior surface of the lid. At any point on the lid 200, the interior surface is the surface which faces toward the first interior space defined by the canopy 222, while the exterior surface is the surface facing away from the first interior space defined by the canopy 222. An aroma aperture 225 can be sized and shaped to receive a portion of the nose of a user while the user drinks the beverage 101 through the lid 200 as shown in FIG. 1. The aroma aperture 225 can be sized and shaped to accommodate the nostrils, the nostrils and a portion of the dorsum of the nose (i.e., the bridge of the nose), or the entire nose. The portion of the lid 200 through which the aroma aperture 225 is defined can be a portion of the cover portion 220 (as is depicted in FIGS. 13A through 16C) or a combination of a portion of the cover portion 420 and a portion of the mounting portion 430 (as is depicted in FIGS. 7-12B).

The cover portion 220 can be contoured to focus or direct aroma vapors (depicted by arrows in FIG. 1) evolved by an aromatic beverage 101 to the aroma aperture 225 so that a more concentrated aroma is delivered to the user when the user's nose is received in the aroma aperture 225 while the user drinks the beverage 101 through the lid 200. In some embodiments, the interior surface of the cover portion 220 is contoured to channel or direct aroma vapors to the aroma aperture 225, while the exterior surface can have a different shape. The cover portion 200 functions differently from traditional beverage container lids because it is designed so that a portion of the nose of a user will pass under the exterior surface of the canopy 222 when the user drinks through the lid 200.

In use, a user can position his or her lips to drink and tilt the beverage container 110 with which the lid 200 is releasably engaged to dispense the beverage 101 through the lid 200 into the mouth of the user. The aroma aperture 225 receives the user's nose and admits the nose into the first interior space defined by the cover portion 220 such that the cover portion 220 covers a portion of the user's nose and concentrates and directs aroma vapors (depicted by arrows in FIG. 1) evolved from the aromatic beverage 101 to the nose while the nose is received in the aroma aperture 225. In this way, the aroma enhancing lids and beverage containers of the present disclosure increase olfactory stimulation, and thus enhance user perception of beverage aroma and overall enjoyment of the beverage 101.

Figure 2:
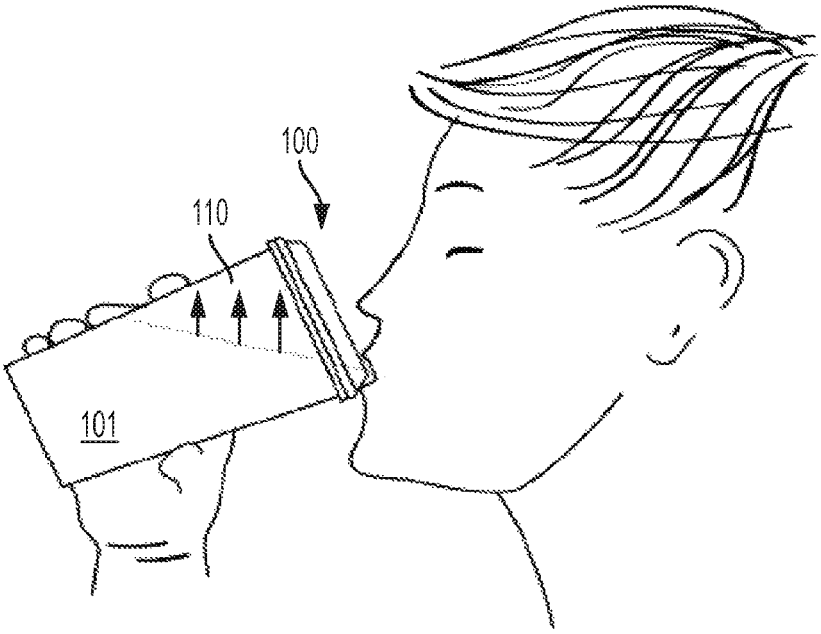
FIG. 2 PRIOR ART
FIG. 2 shows a user drinking a beverage contained in a conventional beverage container through a convention beverage container lid.

By contrast, as shown in FIG. 2, traditional beverage container lids 100 do not include a cover portion 220 configured to cover a portion of the nose of a user and direct aroma vapors to the nose while the user drinks a beverage 101 contained in a traditional beverage container 110 through the lid 100. Rather, traditional beverage container lids 100 typically comprise a generally flat exterior surface through which is defined a small hole for dispensing a beverage 101. Although some traditional lids 100 can include one or more additional holes defined therethough, such additional holes are typically designed as a safety precaution to vent steam away from the face of the user, rather than to focus desirable aroma vapors into the nose of the user and thus enable the user to better perceive the aroma of a beverage 101 while drinking through the lid 100. Even those few lids that purport to enhance aroma employ one or more small holes defined through their upper surfaces to direct aroma vapors to a user. In use, such lids require the nose of the user to be positioned over the hole(s) for the user to experience the aroma, which allows desirable aroma vapors to dissipate into the ambient air before reaching the nose. As a result, such lids 100 unnecessarily limit user perception and enjoyment of the aroma of a beverage 101.

It should be understood that although the cover portion 220 of the aroma enhancing beverage container lids 200 depicted in FIGS. 1 and 13A through 16C are shown as generally dome-shaped, the exterior surface of the cover portion 220 can take any shape that allows a portion of the canopy 222 to cover a portion of the nose of a user and focus aroma vapors to the nose while the user drinks a beverage 101 through the lid 200. Accordingly, in some embodiments, the interior surface of the cover portion 220 can be contoured to concentrate aroma vapors evolved from the beverage 101 as steam or otherwise (depicted by arrows in FIG. 1) in the first interior space defined by the cover portion 220 and direct such aroma vapors to the aroma aperture 225, while the exterior surface of the cover portion 220 can be configured with any functional or aesthetically desirable shape, including geometric shapes and shapes which resemble animals, flowers, and cartoon characters. It should be noted, however, that lids 200 having a profile that permits each lid to be easily stacked inside another require less storage space during transport and in warehouses, cafes, offices, and restaurants, where space is often limited, and can be sold using more compact packaging.

The size and configuration of the aroma aperture 225 defined in the cover portion 220 can also provide increased user comfort when drinking by allowing a user to drink from a more natural drinking position similar to that experienced when using traditional open-top beverage containers. For example, conventional lids 100 such as the one exemplified in FIG. 2 oblige the user to tilt the head further and further back to access the entirety of the beverage 101 and to avoid contacting an exterior surface of the lid 100 with the tip of the user's nose. This can place an uncomfortable strain on the user's neck, as well as block the user's line of sight to the beverage and potentially dangerous conditions in front of the user.

By contrast, with the user's nose able to extend through the aroma aperture 225 into the interior space defined by the cover portion 220, the aroma enhancing lids and beverage containers of the present disclosure allow the user to keep the neck and head more upright while drinking the entirety of a beverage 101 and minimize the degree of head inclination required for the user to continually access a beverage 101 as the level of the beverage in a beverage container 110 decreases during consumption. This simultaneously alleviates neck strain and allows the user to maintain a clear forward field of vision while drinking. A large aroma aperture 225 also enables a user to see and interact with a beverage 101 contained in a beverage container 110, including by stirring the beverage 101 or adding ingredients such as add tea, milk, cream, and sugar without removing the lid 200 from the container 110.

In some embodiments of the novel beverage containers and lids disclosed herein, the aroma aperture 225 is the aperture through which the user drinks a beverage 101 or other liquid foodstuff, such as a soup. This has the advantageous effect of allowing the nose to pass through the aroma aperture 225 and under a portion of the cover portion 220 such that the canopy 222 covers a portion of the nose when the user drinks through the lid 200. This leverages the previously described internal surface contouring of the cover portion 220 to focus aroma vapors toward the mouth and nose simultaneously, thereby enabling the user to better perceive the aroma of the beverage by retronasal and orthonasal olfaction.

However, in other embodiments, the aroma enhancing beverage containers and lids disclosed herein can include a second separate aperture through which the user drinks. The second aperture can be a drink aperture 275 through which a beverage 101 is dispensed when the user tilts the beverage container 110 toward the mouth to drink as shown in FIG. 1. The drink aperture 275 and aroma aperture 225 can be aligned along a diameter of a circle defined by a circumference of the mounting portion 230 of the lid 200, with the aroma aperture 225 defined through a portion of the lid 200 closer to the center of the cover portion 220 than the drink aperture 275. The drink aperture 275 can be defined through a portion of the lid 200 that is radial of the aroma aperture 225 from an apex 224 or a center of the cover portion 220. Put differently, the drink aperture 275 can be closer to the exterior perimeter or circumference of the lid 200 than the aroma aperture 225. Put yet another way, the drink aperture can be positioned closer to the edge of a lid 200 than the aroma aperture 225.

The aroma aperture 225 can be larger than the drink aperture 275 such that an area of the aroma aperture 225 is larger than an area of the drink aperture 275. The aroma aperture can have a first area, and the drink aperture can have a second area, and the first area can be from about 1.5 to about 150 times greater than the second area. In some embodiments, the aroma aperture 225 can have a width that is greater than a width of the drink aperture 275, and a length that is greater than a length of the drink aperture 275. The aroma aperture 225 can also have a minimum width which is greater than a maximum width of the drink aperture 275. The aroma aperture 225 can also have a height 295 which is greater than a height of the drink aperture 275 such that the aroma aperture 225 can extend to a height above the drink aperture 275.

Referring again to FIGS. 13A through 16C, a drink aperture 275 can be also defined through a portion of the lid 200 located below or at about the same height as the bottom edge of the aroma aperture 225, so that a beverage 101 flows through the drink aperture 275 before the aroma aperture 225 when a beverage container or lid disclosed herein is tilted to dispense a beverage 101 contained therein. The drink aperture 275 can also be smaller than the aroma aperture 225 to protect the user from over dispensation and inadvertent spills. For example, the drink aperture 275 can have a perimeter that defines an area less than an area defined by a perimeter of the aroma aperture 225. In this way, the aroma aperture 225 can be larger than the drink aperture 275. Additionally, the aroma aperture 225 can extend farther in a direction away from the beverage container 110 than the drink aperture 275. Similarly, the aroma aperture 225 can extend to a height greater than the height of the drink aperture 275. A beverage container or lid disclosed herein can also include other additional openings or apertures in addition to an aroma aperture and a drink aperture, which can provide other advantageous functions, such as steam venting or attachment points for a selectively releasable cover or closure member.

It should be understood that the aroma enhancing beverage container lids disclosed here can also include a conventional beverage container 110 integrally coupled thereto. Thus, in some embodiments, the aroma enhancing beverage container lids disclosed herein can be formed as one piece with a conventional beverage container 110 to provide an aroma enhancing beverage container 300 having all of the above described features and benefits of an aroma enhancing beverage container lid. Accordingly, another aspect of the present disclosure includes an aroma enhancing beverage container 300 comprising an aroma enhancing beverage container lid integrally formed on, or in some embodiments coupled to, a conventional beverage container 110. Notably, such aroma enhancing beverage containers can omit a mounting portion because the cover portion 320 and beverage container portion 310 of the device are formed as one piece and are not selectively releasable from one another.

Accordingly, FIGS. 3A through 3D depict an aroma enhancing beverage container 300 constructed in accordance with another aspect of the present disclosure. The beverage container 300 includes a body portion 310 adapted to be held in the hand of a user, and a cover portion 320 integrally formed with the body portion. The body portion 310 defines an interior space for containing a beverage or liquid foodstuff while the body portion 310 is in an upright position. The body portion 310 can take the form of any conventional beverage container having a base 312 and one or more side walls 314 extending generally upwardly from the base to form a rim 316 at a first height above the base 312. The cover portion 320 can include an upwardly convex canopy 322 extending generally upwardly along a curvature of the cover portion 320 from the rim 316. The canopy 322 can define an interior space for collecting and concentrating aroma vapors evolved from an aromatic beverage contained in the interior space of the body portion 310. In certain embodiments, the upwardly convex canopy 322 can be a dome having an apex 324 at a second height above the rim 316 of the body portion 310.

An aroma aperture 325 can be defined through a portion of the body portion 310, the cover portion 320, or both. The aroma aperture 325 can have a shape that tapers toward the second height. In some embodiments, the widest portion of the aroma aperture 325 can be defined through a portion of the beverage container 300 near the first height, while the narrowest portion of the aroma aperture can be defined through a portion of the cover portion 320 near the second height. In some embodiments, the widest portion of the aroma aperture 325 is at least as wide as the nose of a user.

The aroma aperture 325 can include a bottom edge 326 which can form a lip portion for receiving the lips of a user when the user drinks a liquid foodstuff contained in the body portion 310 through the aroma aperture 325 as exemplified in FIG. 1. In some embodiments, the lip portion 326 can be an arc of the rim 316 defined by the sidewall 314 of the body portion 310. The bottom edge 326 of the aroma aperture 325, and thus the lip portion, can extend from a first rim position 327 to a second rim position 329 spaced an arc length 323 around the rim 316 from the first rim position 327. The arc length 323 can range from about 15% to about 50% of the perimeter of the rim 316. In some embodiments wherein the rim 316 defined by the sidewall 314 of the body portion 310 is circular, the arc length 323 can range from about 30% to about 50% of the circumference of the rim 316. In some circular embodiments, the second rim position 329 can be spaced from about $\pi/6$ radians (i.e., 30°) to about $\pi$ radians (i.e., 180°) around a circumference of the rim 316 from the first rim position 327. In certain embodiments, the second rim position 329 can be spaced from about $2\pi/6$ radians (i.e., 60°) to about $5\pi/6$ radians (i.e., 150°) around a circumference of the rim 316 from the first lip position 327. In one embodiment, the arc length 323 can be from about $2\pi/6$ radians (i.e., 60°) to about $2\pi/3$ radians (i.e., 120°) of the circumference of the rim 316 of the body portion 310. In another embodiment, the arc length 323 can range from about the width of the nose of a user to about the width of the mouth of a user.

Figure 3A:
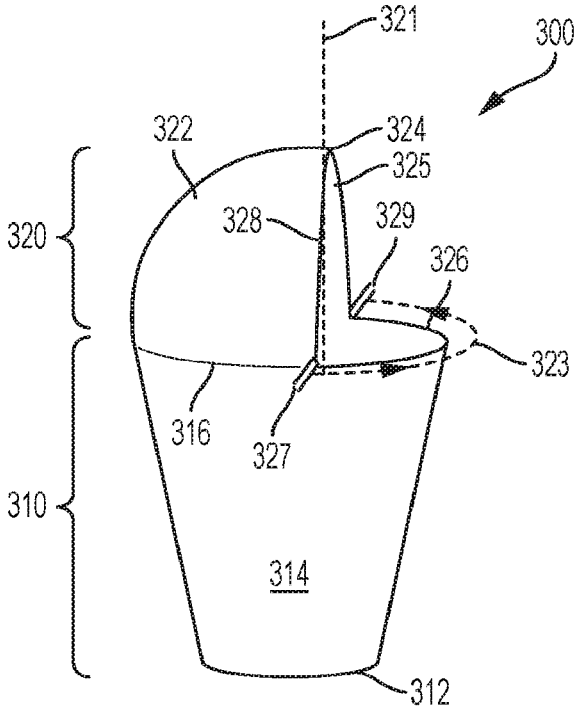
FIG. 3A is a perspective view of an embodiment of an aroma enhancing beverage container constructed in accordance with another aspect of the present disclosure.
Figure 3B:
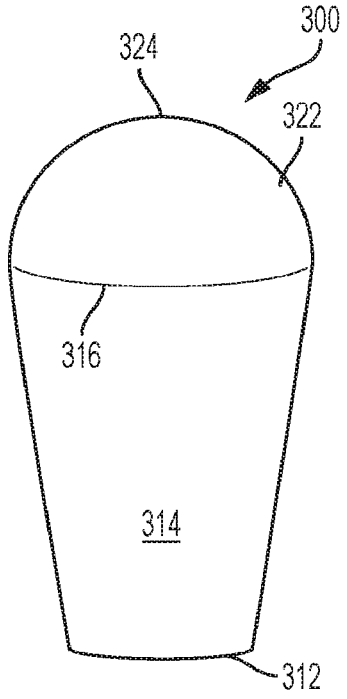
FIG. 3B is a rear view of the beverage container of FIG. 3A.
Figure 3C:
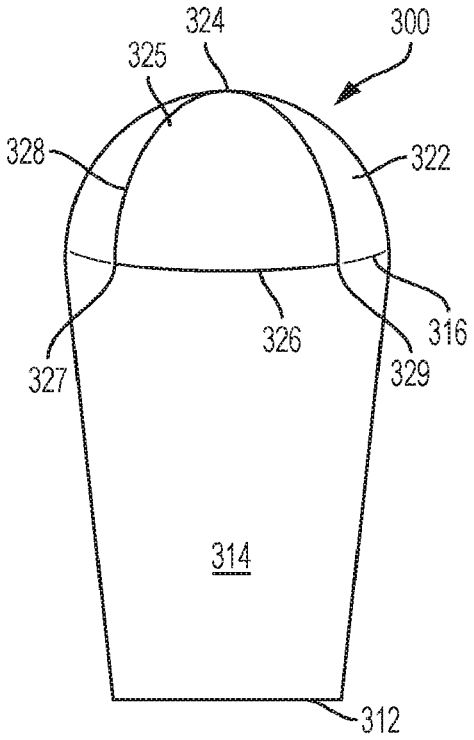
FIG. 3C is a front view of the beverage container of FIG. 3A.
Figure 3D:
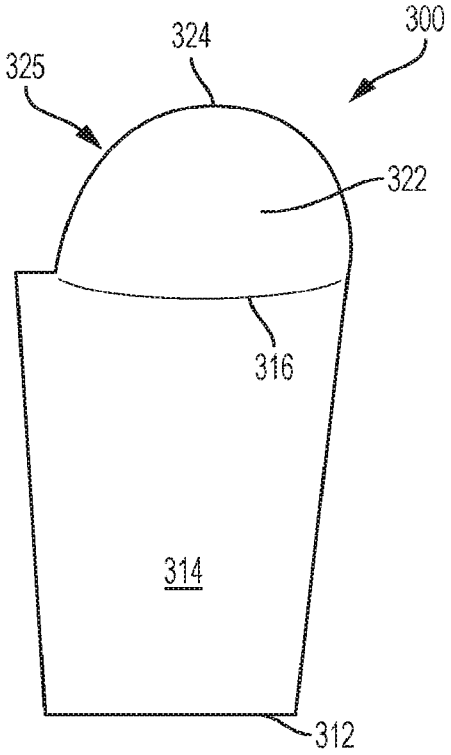
FIG. 3D is another perspective view of the beverage container of FIG. 3A.

The aroma aperture 325 can also include a second edge 328 defined in the canopy 322 which extends generally upwardly along a curvature of the canopy 222 from the first and second rim positions 327, 329 to an apex 324 spaced a height above the rim 316 of the body portion 310. The second edge 328 can be substantially planar and can extend generally upwardly along a curvature of the canopy 322 from each of the first and second rim positions 327, 329 in a vertical reference plane 321 to the second height, which in some embodiments, can be the apex 324 of the canopy portion 322. An angle formed in a side of the beverage container 300 by the intersection of the vertical reference plane 321 and the plane containing the lip portion 326 can be a right angle, as depicted in FIG. 3A. In other embodiments, the reference plane 321 can be a non-vertical plane such that the angle formed in the side of the beverage container 300 by the intersection of the second edge 328 and the lip portion 326 is an acute angle. It should be understood, however, that the overall shape and proportions of the aroma aperture 325, the cover portion 320, and the body portion 310 can vary from the embodiment depicted in FIGS. 3A-3D.

Figure 4:
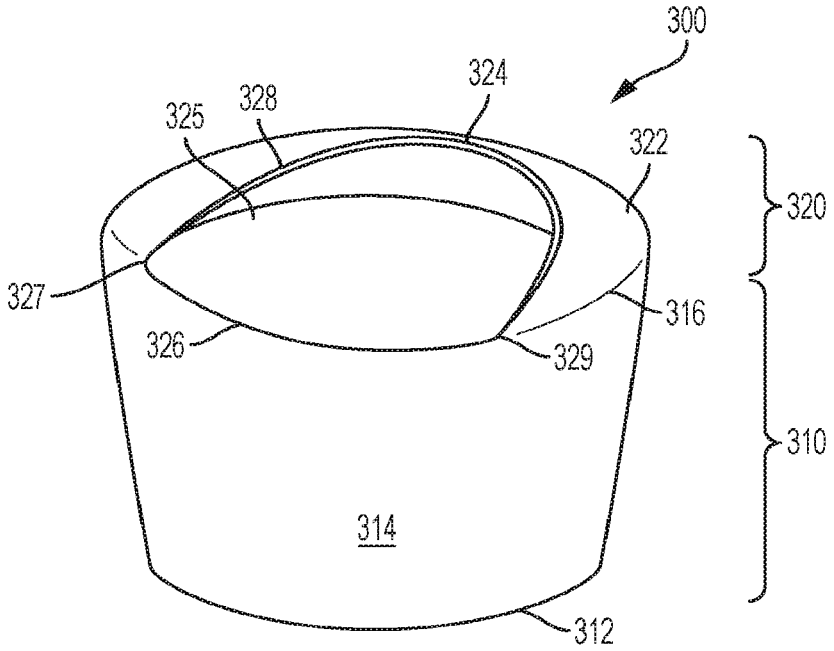
FIG. 4 is a perspective view of another embodiment of an aroma enhancing beverage container.

Referring now to FIGS. 4, 5, and 6A-6B, there are depicted three alternate embodiments of novel aroma enhancing beverage containers 300 formed in accordance with the principles of the present disclosure, which illustrate some of the variability in the shape and size of the body portion 310, cover portion 320, and aroma aperture 325 encompassed within the scope of the present disclosure. Specifically, FIG. 4 depicts an aroma enhancing beverage container 300 having a shorter, less tapered body portion 310 with a wider opening defined by a rim 316, a lower canopy 322, and an apex 324 positioned closer to the opposite side of the rim 316 from the lip portion 326 than does the aroma enhancing beverage container 300 depicted in FIGS. 3A-3D. The difference between the height of the rim 316 and the height of the apex 324 of the canopy 322 is also less than that of the aroma enhancing beverage container 300 depicted in FIGS. 3A-3D. By contrast, the aroma enhancing beverage container 300 of FIG. 5 has a taller, more tapered body portion 310 and a more rounded aroma aperture 325 with an apex 324 positioned nearer a longitudinal axis extending through the geometric center of a circle defined by the rim 316 and base 214 of the body portion 314. Further, the aroma enhancing beverage container 300 depicted in FIGS. 6A-6B has a body portion 310 similar in shape to that of a traditional soup bowl with a much lower and wider rim 316 and larger aroma aperture 325.

In use, a liquid foodstuff such as an aromatic beverage or soup is placed into the interior space defined by the body portion 310. A user then drinks the liquid foodstuff from the beverage container 300 through the aroma aperture 325 as exemplified in FIG. 1 by placing the lips on the lip portion (i.e., the bottom edge 326 of the aroma aperture 325) and tilting the beverage container 300 towards the user's face until a portion of the nose passes through the aroma aperture 325 and into the interior space defined by the lid portion 320 such that the nose is at least partially covered by the canopy 322. The interior surface of the canopy 322 will direct concentrated aroma vapors evolved from the liquid foodstuff toward the aroma aperture 325, and thus the nose of the user, thereby increasing perception by the user of the aroma of the foodstuff.

The aroma enhancing beverage containers and beverage container lids disclosed herein can also include additional structural features which increase user convenience and further enhance the concentration and delivery of desirable aroma vapors to a user through the aroma aperture. Accordingly, in some embodiments, the aroma enhancing beverage containers disclosed herein can be formed with a utensil anchor 340 configured to anchor one or more devices commonly used by consumers during preparation or consumption of liquid foodstuffs, including but not limited to, a spoon, a strainer, or a tea bag, to the sidewall 314 of the body portion 310 or the canopy 322 of the cover portion 320.

Figure 5:
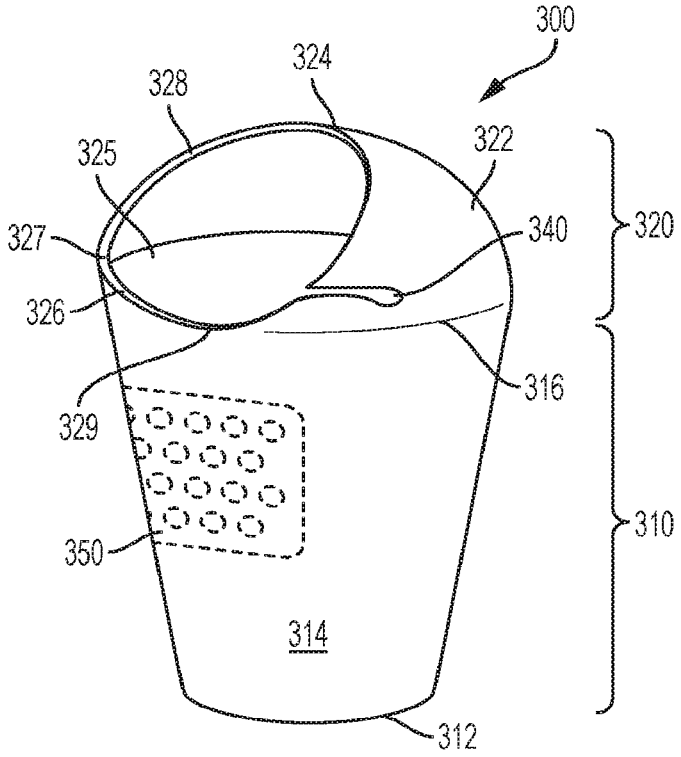
FIG. 5 is a perspective view of yet another embodiment of an aroma enhancing beverage container.
Figure 6A:
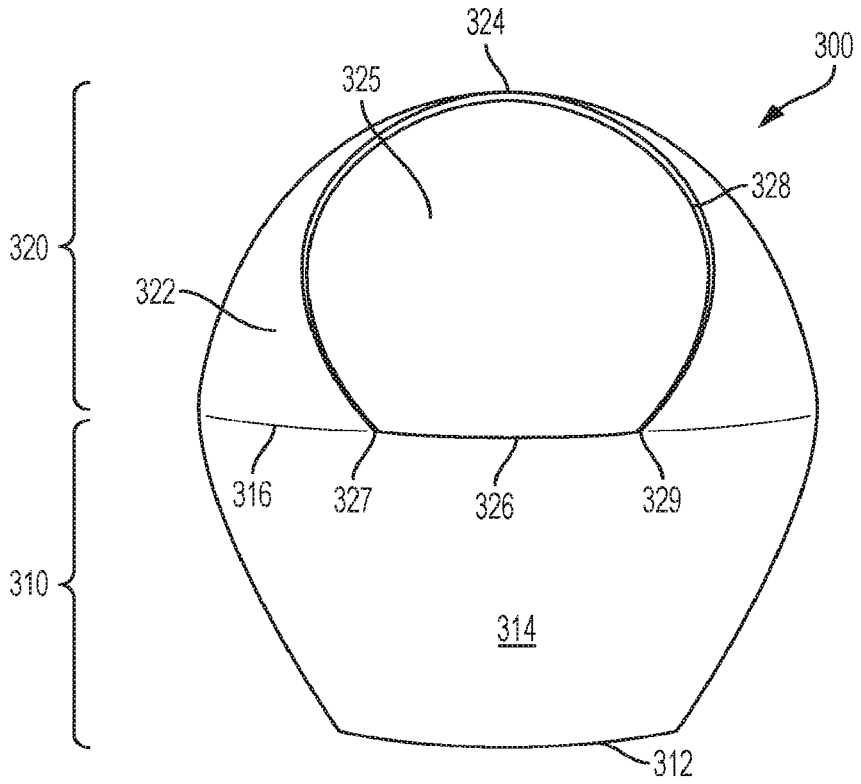
FIG. 6A is a front view of still yet another embodiment of an aroma enhancing beverage container.
Figure 6B:
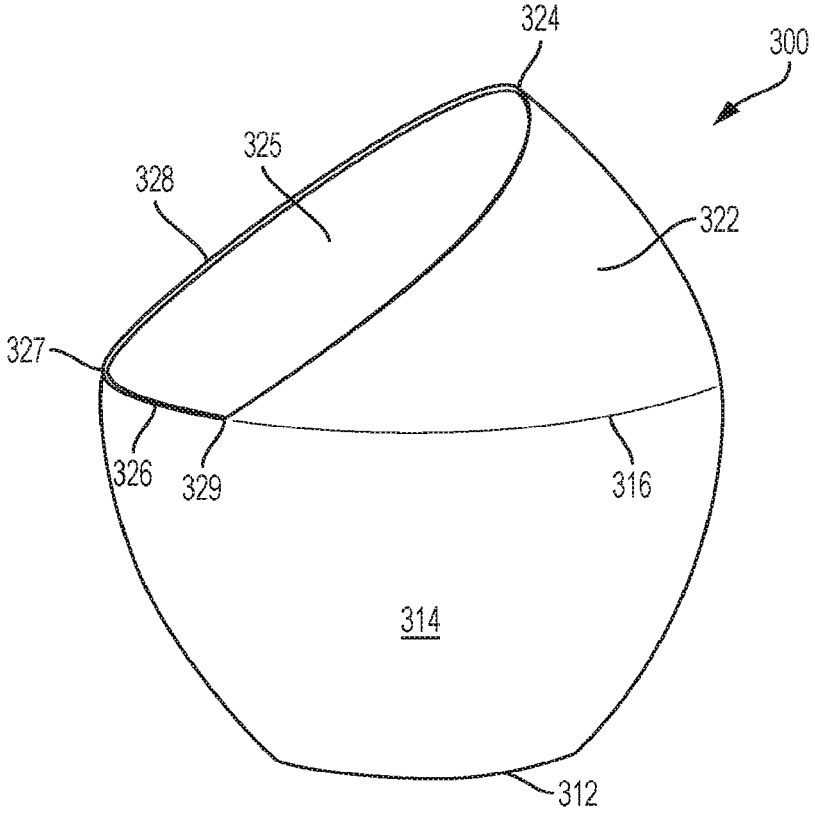
FIG. 6B is a perspective view of the aroma enhancing beverage container of FIG. 6A.
Figure 7:
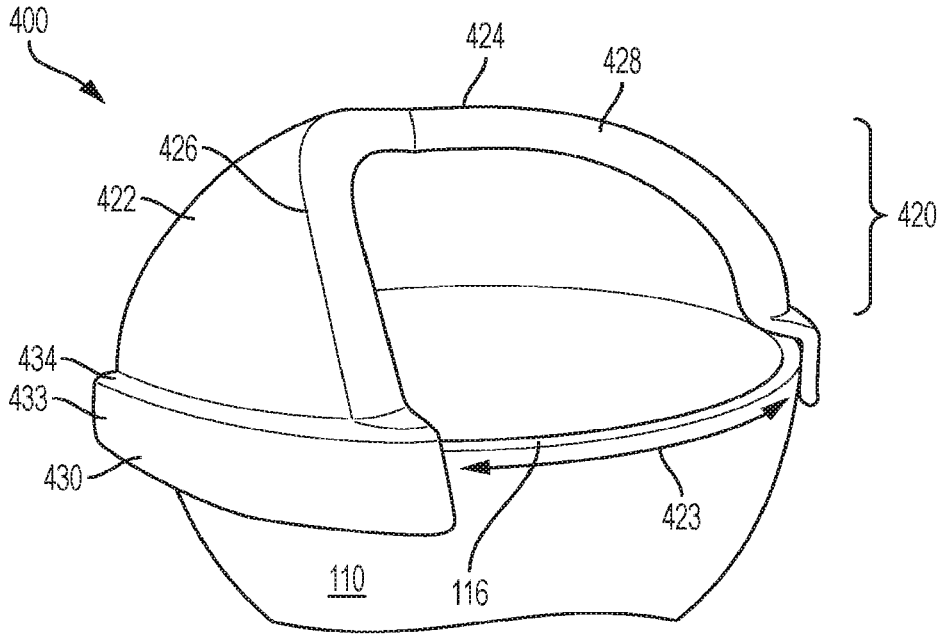
FIG. 7 is a perspective view of an aroma enhancing beverage container lid constructed in accordance with another aspect of the present disclosure showing the lid engaged with a conventional beverage container.
Figure 8:
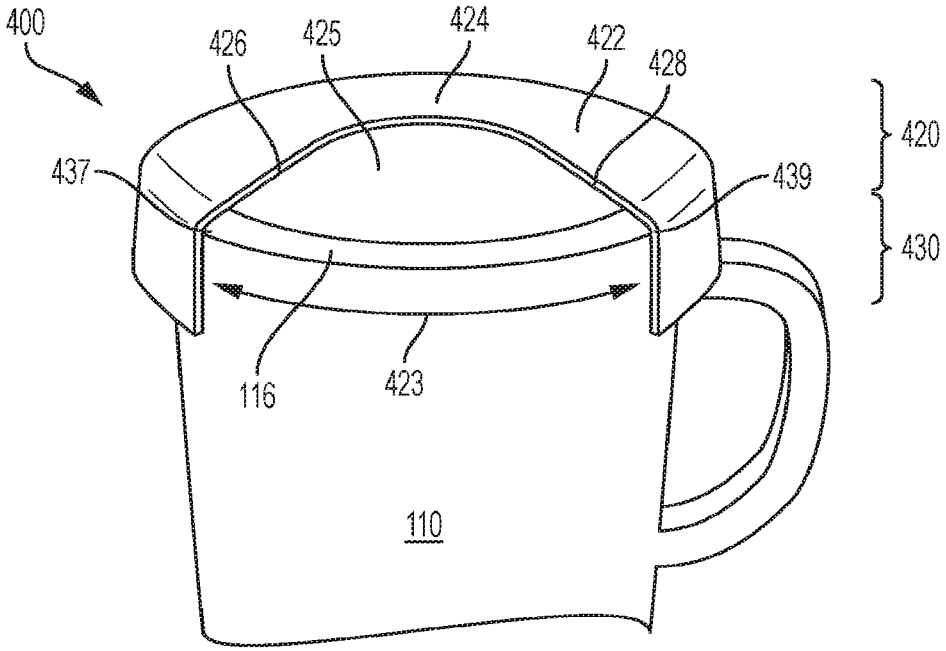
FIG. 8 is a front perspective view of another embodiment of an aroma enhancing beverage container lid engaged with the opening of a conventional beverage container.

In illustration of this concept, the embodiment of an aroma enhancing beverage container 300 depicted in FIG. 5 is provided with a utensil anchor 340 formed in a portion of the canopy 322. The utensil anchor 340 is configured to receive and anchor to the side wall 314 of the beverage container 300 an individually-wrapped tea bag having a tag attached by a string (not shown), which is well known to consumers of aromatic beverages. To use the anchor 340, a user can place the tea bag inside the interior space defined by the body portion 310 and slide the string along an edge of the aroma aperture 325 into the utensil anchor 340 while holding the tag outside the beverage container 300. Once the tea bag string is received in the utensil anchor 340, the user can release the string and the anchor 340 will hold the tea bag in place by preventing the tag from pulling through or sliding out of the anchor 340. This advantageously prevents the tea bag string and tag from inadvertently falling into the liquid foodstuff contained within the beverage container 300 during preparation or consumption of the foodstuff by a user.

Referring again to FIG. 5, a utensil anchor 340 can comprise a generally downwardly curving slot extending through a portion of the canopy 322 from the second edge 328 of the aroma aperture 325 to a location spaced a distance around the perimeter of the canopy 322 from the second edge 328. However, it should be understood that the utensil anchor 340 can take other forms configured to receive and hold in place other devices such as a spoon, tea diffuser, or strainer. The utensil anchor 340 can be positioned above the rim 316 of the body portion 310 so as to prevent a liquid foodstuff contained therein from inadvertently spilling through the anchor 340 while the foodstuff is consumed by a user through the aroma aperture 325.

The aroma enhancing beverage containers and lids disclosed herein can also be provided with an ingredient pocket 350 (show in broken lines in FIG. 5) configured to allow one or more foods, medications, or food ingredients, such as coffee beans, coffee grounds, tea bags, tea leaves, herbs, spices, and other aromatic, flavorful, soothing or medically beneficial ingredients which a user may desire to infuse into a liquid foodstuff (collectively referred to herein as "food ingredients"), to diffuse into a liquid foodstuff or into steam evolved by a hot liquid foodstuff.

An embodiment of an ingredient pocket 350 configured to hold a food ingredient therein and allow the ingredient to diffuse into a liquid foodstuff contained in a beverage container 300 is depicted in FIG. 5. The ingredient pocket 350 can be a permeable wall 350 formed on an interior surface of the sidewall 314 or the canopy 322. Like a conventional shirt pocket, the ingredient pocket 350 can define a space for holding an ingredient between the ingredient pocket wall 350 and the portion of the interior surface on which the ingredient pocket 350 is formed. The space defined between the ingredient pocket 350 and the sidewall 314 is accessible through an opening defined by an uppermost edge of the ingredient pocket wall 350.

The ingredient pocket 350 can be formed from a woven, knit, or otherwise water permeable material and attached to the internal surface of an aroma enhancing beverage container or beverage container lid using methods known in the art. Alternatively, the ingredient pocket 350 can be formed of a material that is impermeable to water, including without limitation, glass, ceramic, and food grade plastics. In such water impermeable embodiments, the ingredient pocket wall 350 can be formed with one or more holes (shown in broken lines) defined therethrough to allow desirable compounds or components of the ingredient to diffuse from the ingredient through the pocket 350 into the liquid foodstuff or steam while the bulk of the ingredient itself is retained in the pocket 350. In certain embodiments, the ingredient pocket 350 can be formed as an integral part of an aroma enhancing beverage container or lid from the constituent material of the beverage container or lid.

An ingredient pocket 350 can be formed on any interior surface of an aroma enhancing beverage container or beverage container lid disclosed herein, including the interior surface of the canopy 322. However, it should be understood that the location of an ingredient pocket placement impacts the utility of the pocket. Specifically, placement of an ingredient pocket 350 on the interior sidewall 314 proximate to the aroma aperture 325 can advantageously increase user perception and enjoyment of the aroma and flavor of a liquid foodstuff contained in the beverage container 300 because aroma and flavor compounds released by an ingredient disposed in an ingredient pocket so placed will necessarily be more concentrated in the liquid near the pocket 350 than elsewhere in the beverage container 300. In this way, aroma enhancing beverage containers provided with an ingredient pocket 350 on the interior sidewall 314 below the aroma aperture 325 can deliver more concentrated foodstuff aroma and flavor to a user.

By contrast, placement of an ingredient pocket 350 on an interior surface the canopy 322 of the aroma enhancing beverage containers and lids disclosed herein can allow steam evolved from a hot liquid contained in the beverage container 300 to pass through the permeable pocket wall 350 to the food ingredient contained therein, causing the steam trapped inside the canopy 322 to become increasingly infused with the aroma of the ingredient. This can be particularly advantageous for use with aromatherapeutic or medically active food ingredients that can be inhaled by the user.

Turning now to FIGS. 7 through 12B, there are depicted various embodiments of aroma enhancing beverage container lids 400 having an aroma aperture 425 defined through portions of both the mounting portion 430 and the cover portion 420. Each lid 400 is a primary cover member releasably engaged with the opening of a conventional beverage container 110 and comprises a cover portion 420 coupled to a mounting portion 430 configured to releasably engage the rim 116 of a conventional beverage container 110. The cover portion 420 can be a canopy 422 which can define a first interior space in fluid communication with a second interior space defined by the beverage container 110. The aroma aperture 425 can be defined by first and second lateral edges 426, 428, which can extend along a curvature of the canopy 422 from the first and second rim positions 437, 439, respectively, to meet at a vertex located in the canopy 422. The vertex can be disposed at a height that is lower than, equal to, or greater than the height of the mounting portion 430. The aroma aperture 425 can be sized and shaped to receive the nose of a user and admit the nose into the first interior space so that a portion of the canopy 422 covers the nose when the user drinks a beverage through the aroma aperture 425. The canopy 422 can be contoured to focus aroma vapors evolved from a beverage contained within the beverage container 400 to the nose of a user when the user drinks the beverage through the aroma aperture 425.

The mounting portion 430 can include a skirt 433 having an internal flange 434. The skirt 433 can be sized and shaped to fit over the opening of the beverage container 110 and extend downward below the rim 116 such that an internal surface of the skirt 433 frictionally engages an exterior surface of the rim 116 while the flange 434 frictionally engages the top of the rim 116 when the mounting portion 430 is properly engaged with and mounted on the beverage container 110 as shown in FIGS. 7 and 10 through 12B. The interior surface of the skirt 433 can also include an annular groove adapted to matingly engage the complementary peripheral rim 116 of the beverage container 110. In a specific implementation, the skirt 433 can elastically stretch over the rim 116 of the beverage container 110 to form a leak-proof seal.

The portion of the mounting portion 430 through which an aroma aperture 425 is defined can be an arc 423 of the mounting portion 430 extending from a first rim position 437 to a second rim position 439 spaced an arc length around a circumference of the mounting portion 430 from the first rim position 437. The portion of the rim 116 of the beverage container 110 left uncovered by the mounting portion 430 between the first and second rim positions 437, 439 (i.e., the portion of the rim corresponding to the arc 423) of the aroma aperture 425 forms a lip portion for receiving the lips of a user when a user drinks a liquid foodstuff contained in the beverage container 110 through the aroma aperture 425.

The arc length can range from about 15% to about 50% of the perimeter of the mounting portion 430. In embodiments wherein the mounting portion 430 is annular, the arc length can range from about 15% to about 50% of the circumference of the mounting portion 430. In some embodiments, the second rim position 439 can be spaced from about $\pi/6$ radians (i.e., 30°) to about $\pi$ radians (i.e., 180°) around a circumference of the mounting portion 430 from the first rim position 437. In certain embodiments, the second rim position 439 can be spaced from about $2\pi/6$ radians (i.e., 60°) to about $5\pi/6$ radians (i.e., 150°) around a circumference of the mounting portion 430 from the first rim position 437. In one embodiment, the arc length can be from about $2\pi/6$ radians (i.e., 60°) to about $4\pi/6$ radians (i.e., 120°) of the circumference of the mounting portion 430. In another embodiment, the arc length can be from about one-sixth to about one-third of the circumference of the mounting portion 430. In another embodiment, the length of the arc 423 can be equal to or greater than the width of the nose of a user.

The portion of the canopy 422 through which the aroma aperture 425 is defined can include a segment of the canopy 422 defined by an angle subtended by the arc 423 from the vertex in the canopy 422, which in some embodiments, can be an apex 424 of the canopy 422. In other embodiments, the portion of the canopy 422 through which the aroma aperture 425 is defined can include a segment of the canopy 422 defined by an angle subtended by the arc 423 from the apex 424 of the canopy 422. The apex 424 can be located in the geometric center of the canopy 422 or distal from the center of the canopy 422.

Figure 9A:
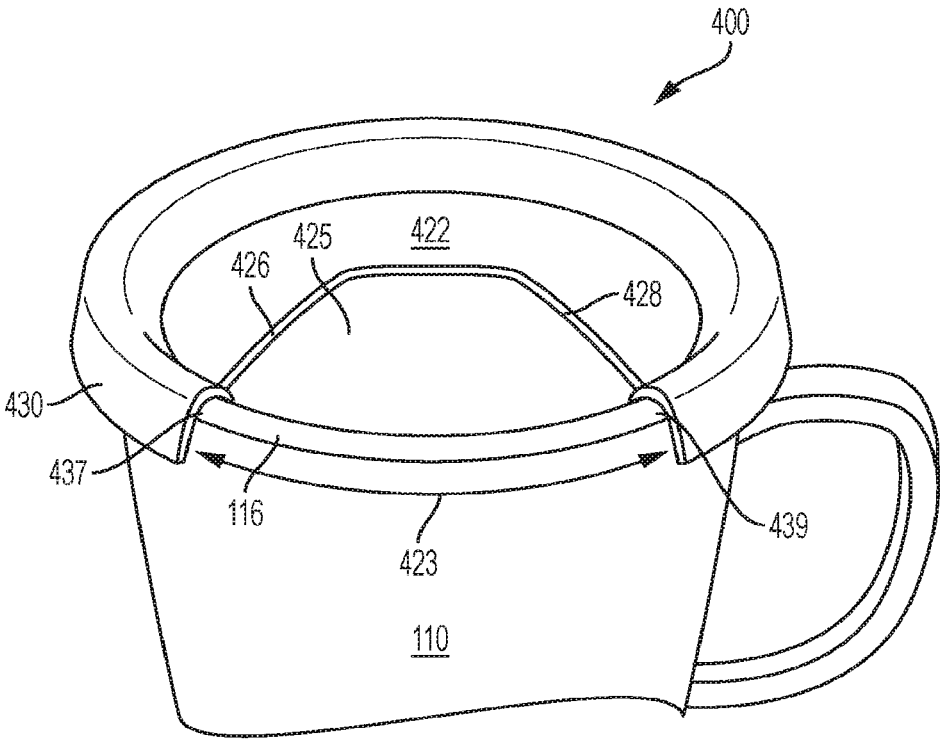
FIG. 9A is a front perspective view of yet another embodiment of an aroma enhancing beverage container lid engaged with the opening of a conventional beverage container.
Figure 9B:
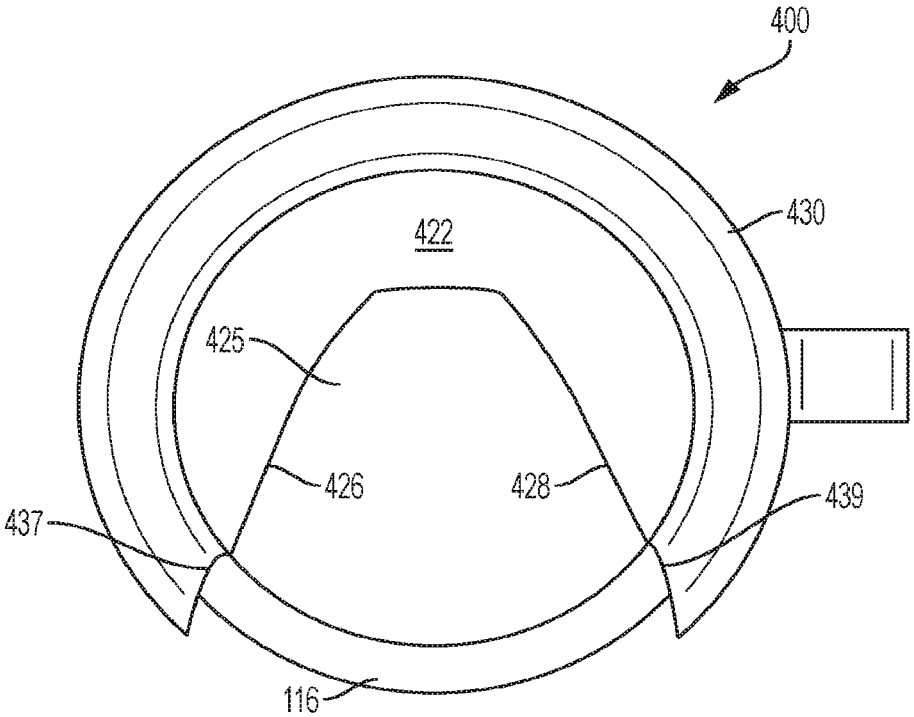
FIG. 9B is a top plan view of the aroma enhancing beverage container lid of FIG. 9A.
Figure 10:
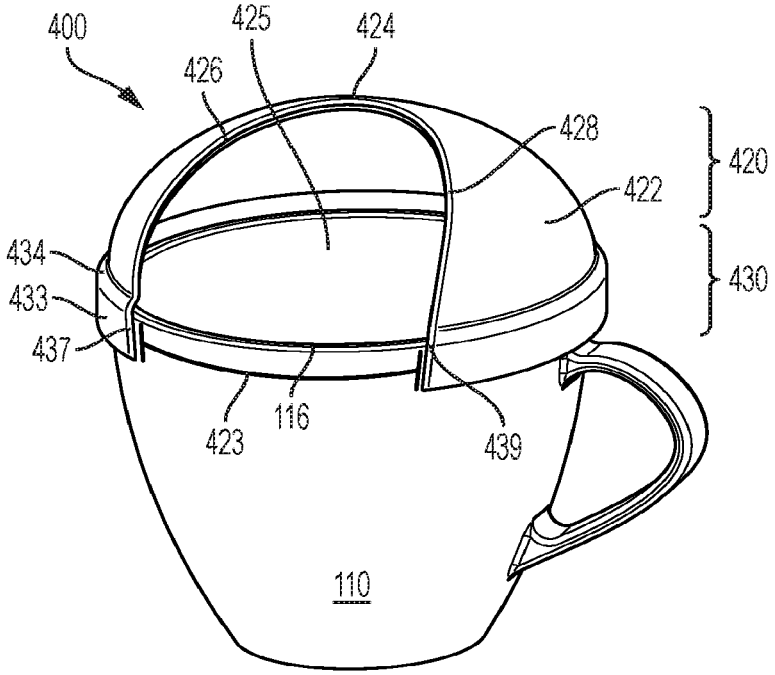
FIG. 10 is a perspective view of still yet another embodiment of an aroma enhancing beverage container lid engaged with the opening of a conventional beverage container.

In some implementations, the difference in height between the vertex or apex 424 and the rim 116 can range from approximately zero units to approximately a distance between a user's mouth and top or root of the nose near the user's eyes, as shown in FIGS. 10 through 12B. In other implementations, the vertex and apex 424 of the cover portion 420 can be can disposed at a height lower than that of the rim 116, so that the canopy 422 of the lid 400 extends below the rim 116 of the beverage container 110, as shown in FIGS. 9A-9B. A canopy 422 which extends below the height the of the rim 116 can provide increased user convenience by functioning as a shelf 422 upon which a user can place various foodstuffs, such as cookies, crackers, and the like. A lower canopy 422 can also better concentrate aroma vapors by concentrating the vapors in a smaller interior space. By contrast, a higher canopy portion 422 can allow a hot beverage to cool faster by providing a greater interior space into which the beverage can dissipate heat. Accordingly, in some embodiments, the first and second lateral edges 426, 428 of the aroma aperture 425 can extend generally upwardly along a curvature of the canopy 422 from the first and second rim positions 437, 439 to a vertex 424 at a height above the rim 116 of the beverage container 110, as shown in FIGS. 7-8, and 10 through 12B. In some other embodiments, the first and second lateral edges 426, 428 of the aroma aperture 425 can extend generally downwardly along a curvature of the canopy 422 from the first and second rim positions 437, 439 to a vertex at a height below the rim 116 of the beverage container 110, as shown in FIGS. 9A-9B.

The aroma enhancing lids 400 disclosed herein can also include a selectively releasable closure member 460 configured to interface with the aroma aperture 425, and in some embodiments, a drink aperture. A selectively releasable closure member 460 can be a cover configured to control the size of an aroma aperture 425. In some embodiments, the selectively releasable closure member 460 can be a cover configured to releasably close or cover an aroma aperture 425. The closure member 460 can selectively hinge, rotate, pivot into and out of the aroma aperture 425. In additional embodiments, the selectively releasable closure member 460 can be configured to selectively seal one or both of an aroma aperture 425 and a drink aperture.

Figure 11:
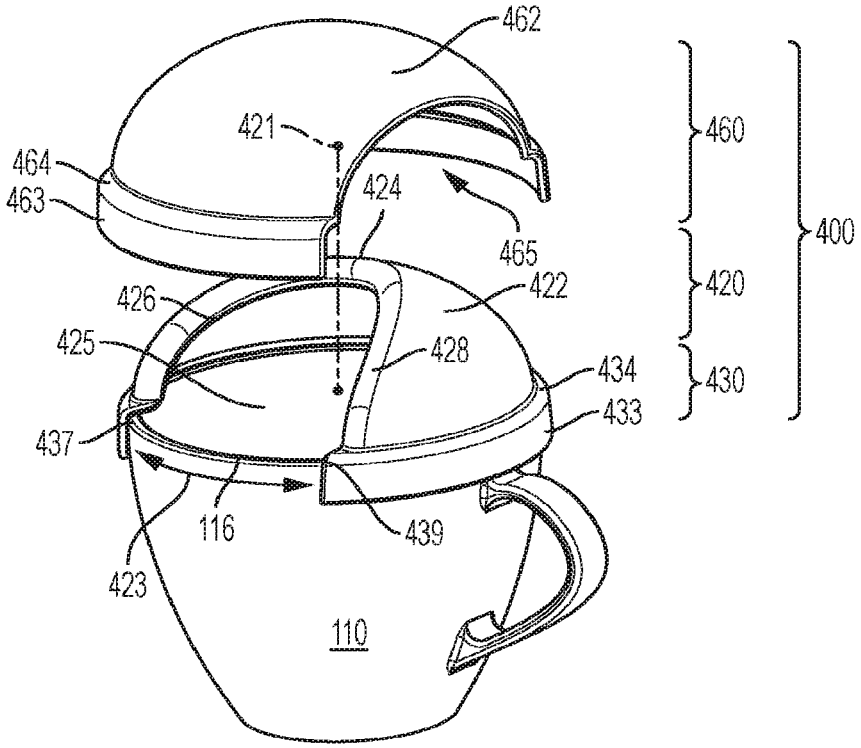
FIG. 11 is a partially exploded perspective view of another embodiment of an aroma enhancing beverage container lid with a selectively releasable closure member engaged with a conventional beverage container.

Referring now to FIG. 11, a selectively releasable closure member 460 can be a secondary cover member configured to lie on top of and selectively rotate around and close the aroma aperture 425 in the primary cover member. The selectively rotatable closure member 460 of FIG. 11 includes a canopy 462 coupled to a mounting portion comprising a skirt 463 and an internal flange 464 like that of the mounting portion 430. The canopy 462 of the closure member 460 is sized and shaped to fit over and releasably engage the canopy 422 and mounting portions 422, 430 of the primary cover member. The closure member 460 can include an aperture 465 extending through a side thereof. The closure member aperture 465 can be smaller than the aroma aperture 425. The closure member 460 can be freely rotated around a central axis 421 extending through the beverage container 110 and the lid 400 so that a user can rotate the closure member 460 to place the aperture 465 in front of the aroma aperture 425 when the user desires to drink; rotate the aperture 465 away from the aroma aperture 425 when the user does not desire to drink; or remove the closure member 460 entirely. In this way, a user can prevent the loss of desirable aroma vapor between sips and control how quickly a hot beverage contained in the beverage container 110 can cool.

Figure 12A:
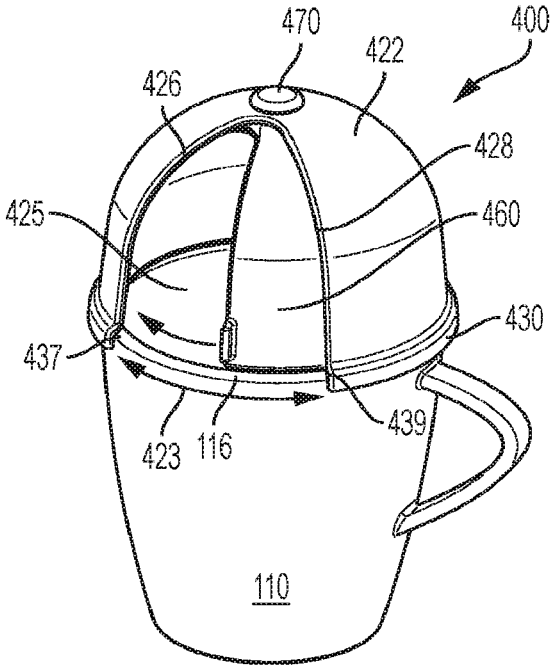
FIG. 12A is a perspective view of another embodiment of an aroma enhancing beverage container lid with a selectively closable closure member in a partially open position.
Figure 12B:
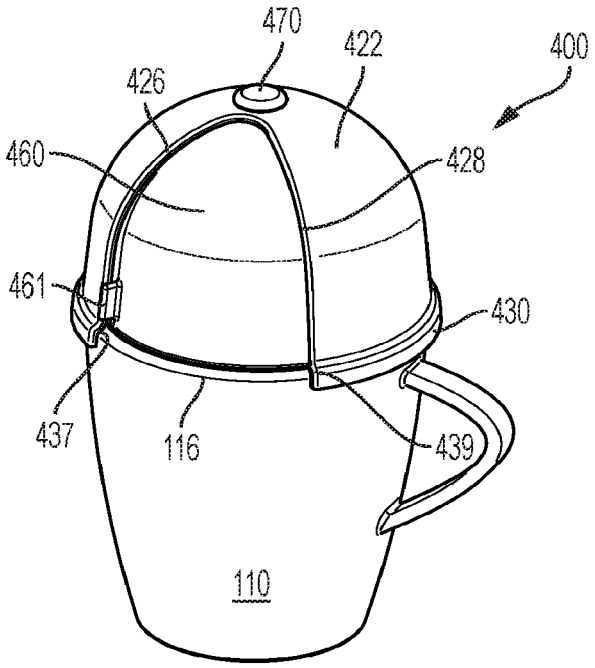
FIG. 12B is a perspective view of the aroma enhancing beverage container lid of FIG. 12A showing the selectively closable closure member in a closed position.

In some embodiments, a selectively releasable closure member 460 can be a selectively closable, rotatable closure member 460 with a handle 461 that protrudes an exterior surface of the member 260, as shown in FIGS. 12A-12B. The selectively closable, rotatable closure member 460 can be coupled to a portion of the canopy 422 by a mechanical fastener 470, such as a rivet, bolt, pin, or other means known in the art. The closure member 460 can be shaped and sized to match the shape and size of the aroma aperture 425. The closure member 460 can also be contoured to reflect a portion of the silhouette or curvature of the canopy 422. The closure member 460 can rotate or pivot around the fastener 470 from a first position wherein the closure member 460 occupies and closes the aroma aperture 425, to a second position wherein the closure member 460 does not occupy and does not close the aroma aperture 425. In this way, the closure member 460 can be rotated to selectively close the aroma aperture 425 by placing the closure member 460 in the first position.

Returning now again to FIGS. 13A through 16C, there are depicted various embodiments of aroma enhancing beverage container lids 200 alike in all respects to the aroma enhancing beverage container lids 400 of FIGS. 7 through 12B except as specifically described herein. The aroma enhancing beverage container lids 200 of FIGS. 13A through 16C include a separate drink aperture 275 in addition to the aroma aperture 225, as described above. Additionally, the aroma apertures 225 of aroma enhancing beverage container lids 200 are defined through the canopy 222 of the cover portion 220, but not the mounting portion 230. In some embodiments, the mounting portion 230 can be configured to releasable yet sealingly engage the rim 116 of a beverage container 110 to prevent leaks when a user drinks a beverage through the aroma aperture 225 or a drink aperture 275 defined through the canopy 222. In some embodiments, the mounting portion 230 can include a skirt 233 having an internal flange 234. The skirt 233 can be sized and shaped to fit over the opening of the beverage container 110 and extend downward below the rim 116 such that an internal surface of the skirt 233 frictionally engages an exterior surface of the rim 116 while the flange 234 frictionally engages the top of the rim 116 when the mounting portion 230 is properly engaged with and mounted on the beverage container 110.

Figure 13A:
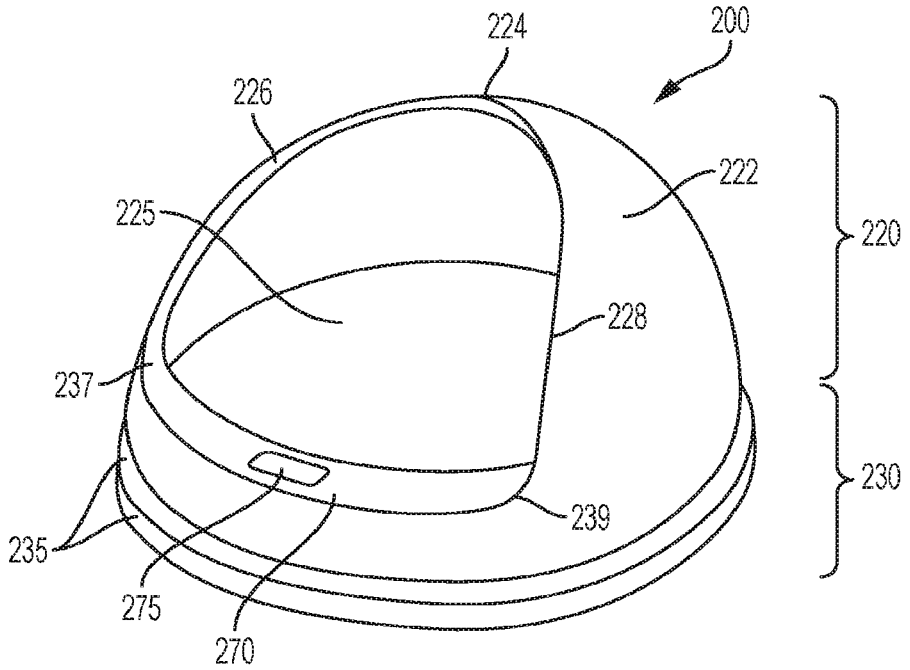
FIG. 13A is a perspective view of an embodiment of an aroma enhancing beverage container lid having separate aroma and drink apertures.
Figure 13B:
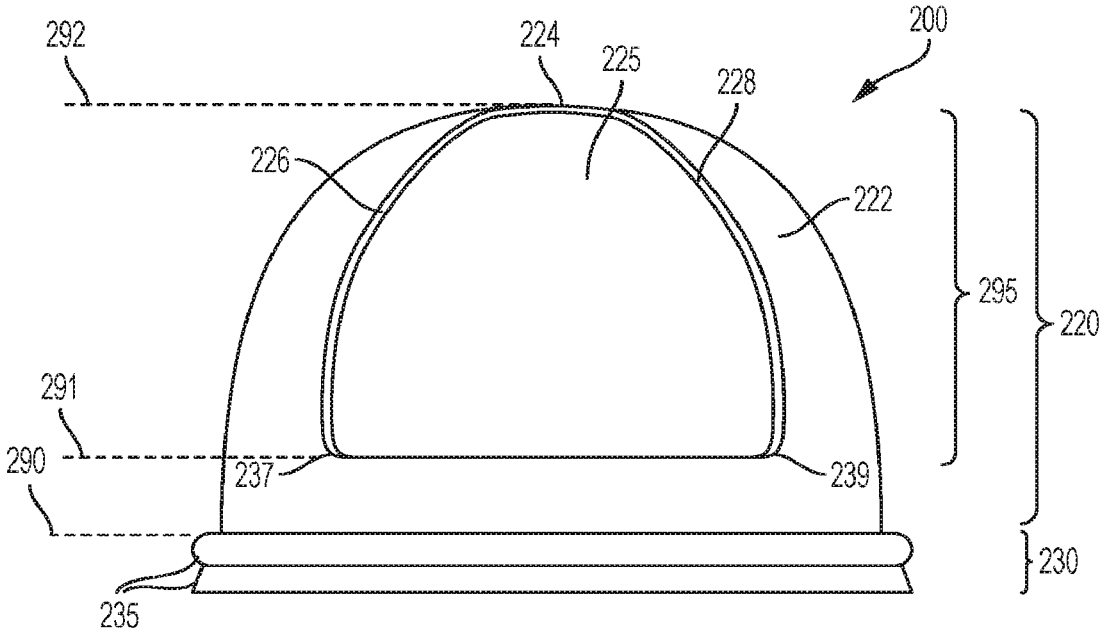
FIG. 13B is a front view of the aroma enhancing beverage container lid of FIG. 13A.
Figure 14A:
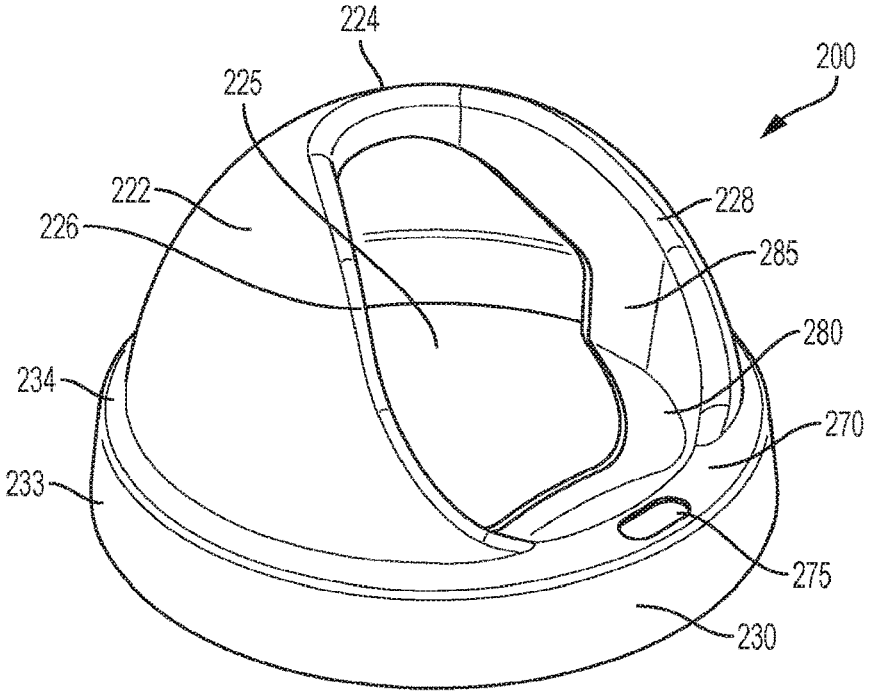
FIG. 14A is a perspective view of an alternate embodiment of an aroma enhancing beverage container lid having separate aroma and drink apertures.
Figure 14B:
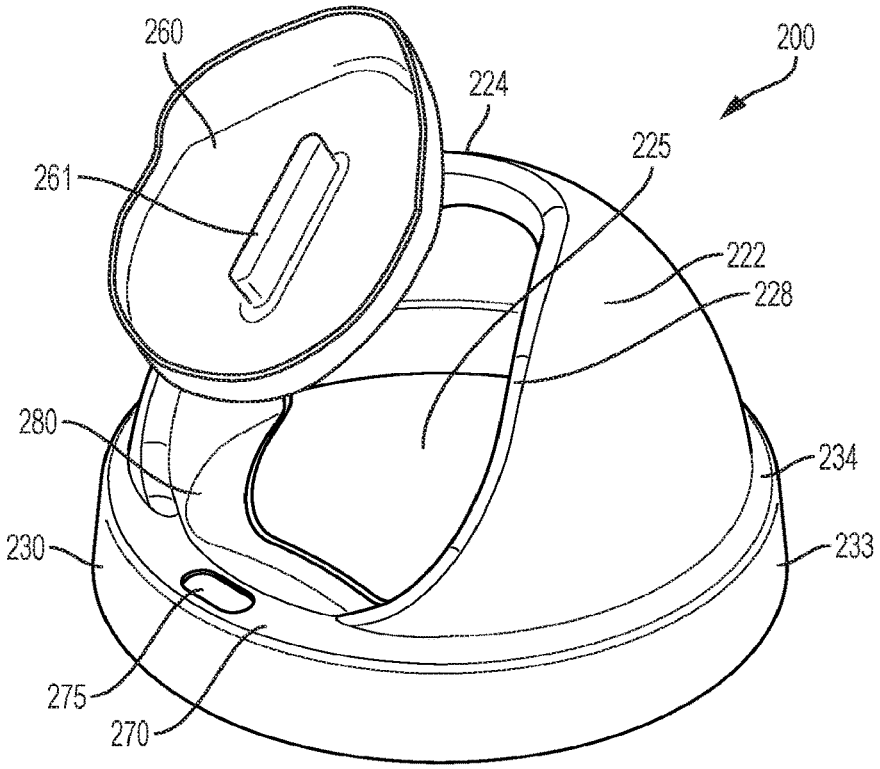
FIG. 14B is another perspective view of the aroma enhancing beverage container lid of FIG. 14A showing a selectively closable closure member positioned for insertion into the aroma aperture.
Figure 14C:
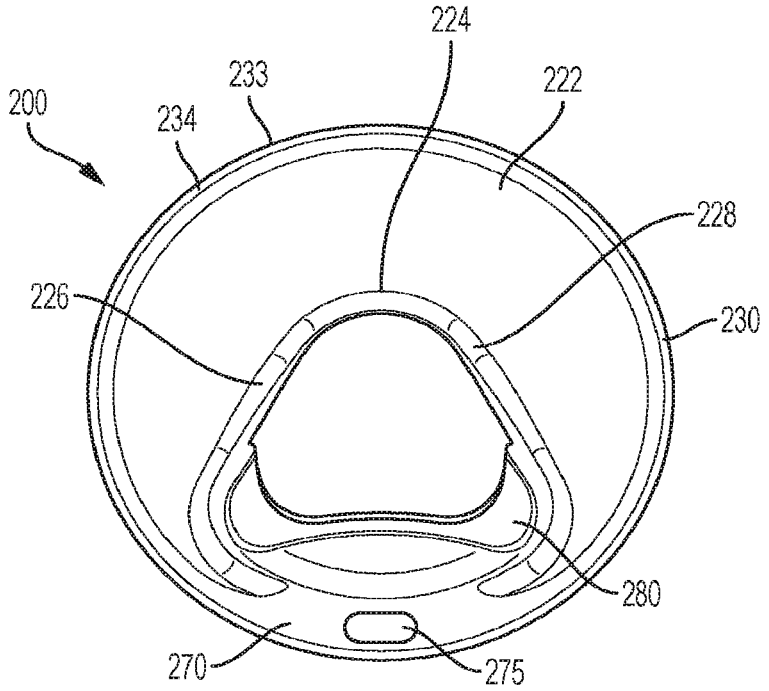
FIG. 14C is a top plan view of the lid of FIG. 14A.
Figure 14D:
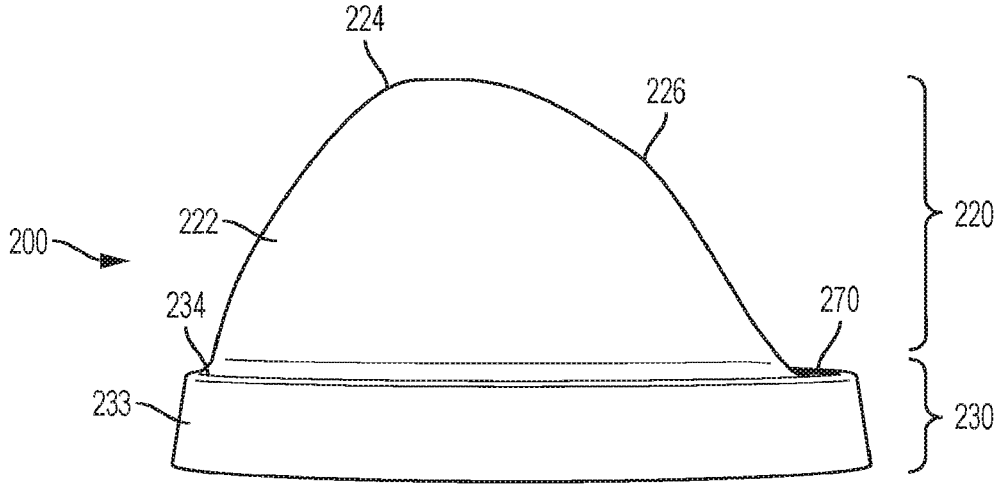
FIG. 14D is a side view of the lid of FIG. 14A, the other side being a mirror image thereof.

As show in FIGS. 13A-13B, the aroma aperture 225 can be defined by a bottom edge and first and second lateral edges 226, 228. The bottom edge can extend circumferentially along an arc of canopy 222 at a first canopy height 291 above the height 290 of the mounting portion 230 from a first lip position 237 to a second lip position 239 spaced an arc length around the canopy from the first lip position 237. The first laterally opposed edge 226 can extend generally upwardly along a curvature of the canopy 222 from the first lip position 237 to a vertex 224 at a second canopy height 292 above the first canopy height 291. The second laterally opposed edge 228 can extend generally upwardly along a curvature of the canopy 228 from the second lip position 239 to the vertex 224. In some embodiments, the vertex can be an apex 224 of the canopy 222.

The arc length can range from about 15% to about 50% of the circumference of the canopy 222. In some embodiments, the arc length can range from about 30% to about 50% of the circumference of the canopy 222. The second lip position 239 can be spaced from about $\pi/6$ radians (i.e., 30°) to about it radians (i.e., 180°) around a circumference of the canopy 222 from the first lip position 237. In certain embodiments, the second lip position 239 can be spaced from about $2\pi/6$ radians (i.e., 60°) to about $5\pi/6$ radians (i.e., 150°) around a circumference of the canopy 222 from the first lip position 237. In one embodiment, the arc length can be from about $2\pi/6$ radians (i.e., 60°) to about $2\pi/3$ radians (i.e., 120°) of the circumference of the canopy 222. In another embodiment, the arc length can range from about the width of the nose of a user to about the width of the mouth of a user.

Referring again to FIGS. 13A through 16C, an aroma enhancing beverage container lid 200 can also include a lip portion 270 for receiving the lips of the user when the user drinks a beverage though the lid 200. The lip portion 270 can be formed in a portion of the cover portion 220, a portion of the mounting portion 230, or portions of both the cover portion 220 and the mounting portion 230.

In some embodiments, including the embodiment shown in FIGS. 13A-13B, the lip portion 270 can comprise an inwardly protruding ledge 270 extending circumferentially along an arc of the canopy 222 from a first lip position 237 to a second lip position 239 spaced an arc length around the canopy 222 from the first lip position 237. The ledge 270 can also include a drink aperture 275 defined therethrough to provide a user increased protection from spills. The lip portion 270 can form a portion of the bottom edge of the aroma aperture 225 such that the lips of a user engage the lip portion 270 and the nose of a user extends into the aroma aperture 225 when the user tilts the beverage container 110 to drink a beverage 101 through the drink aperture 275. The inwardly protruding ledge 270 can be spaced at a first canopy height 291 above the height 290 of the mounting portion 230. In this way, the aroma aperture 225, which can be larger than the drink aperture 275, and can have a height 295 that extends farther in a direction above the mounting portion 230 than the drink aperture 275.

In other embodiments, including the embodiments shown in FIGS. 14A through 16C, the lip portion can be a hollow raised lip portion 270 comprising an exterior wall extending upwardly from a portion of the mounting portion 230, a planar upper surface 270, and an interior wall sloping downwardly from a side of the upper surface opposite the exterior wall. A drink aperture 275 can be defined through a portion of the planar upper surface 270. The hollow raised lip portion 270 can be disposed closer to the exterior perimeter (i.e., edge) of the lid 200 than the aroma aperture 225 such that the nose of a user extends into the aroma aperture 225 when the user drinks the beverage through the drink aperture 275.

In some embodiments, the canopy 222 can include a downwardly extending concave portion, which can include a substantially planar bottom face 280 inset below an exterior surface of the canopy 222 and a downwardly sloping sidewall 285 extending along the first and second lateral edges 226, 228 from the exterior surface of the canopy 222 to the planar bottom face 280. In some embodiments, the aroma aperture 225 can be defined through a portion of the planar bottom face 280, a portion of the sidewall 285, or portions of both the planar bottom face 280 and the sidewall 285. In such embodiments, the sidewall 285 of the canopy 222 can be the portion of the canopy 222 which covers a portion of the user's nose when the user drinks a beverage in the beverage container 110 through the lid.

FIGS. 14B, 15, and 16A-16C also depict various embodiments of aroma enhancing beverage container lids 200 including selectably releasable closure members 260 having a handle 261. In some embodiments, the closure member 260 can be configured to selectably seal the aroma aperture 225 of the lid (see FIG. 14B) when the closure member 260 is placed in the aroma aperture 225 to close the aperture. A closure member 260 configured to seal an aroma aperture 225 can be a closure member that is shaped to fit into and seal the aroma aperture 225, like a cork for a wine bottle. The closure member 260 can include a sealing member on a surface thereof that frictionally engages with a perimeter of the aroma aperture 225 to hold the closure member 260 in place and form a spill-proof seal.

Figure 15:
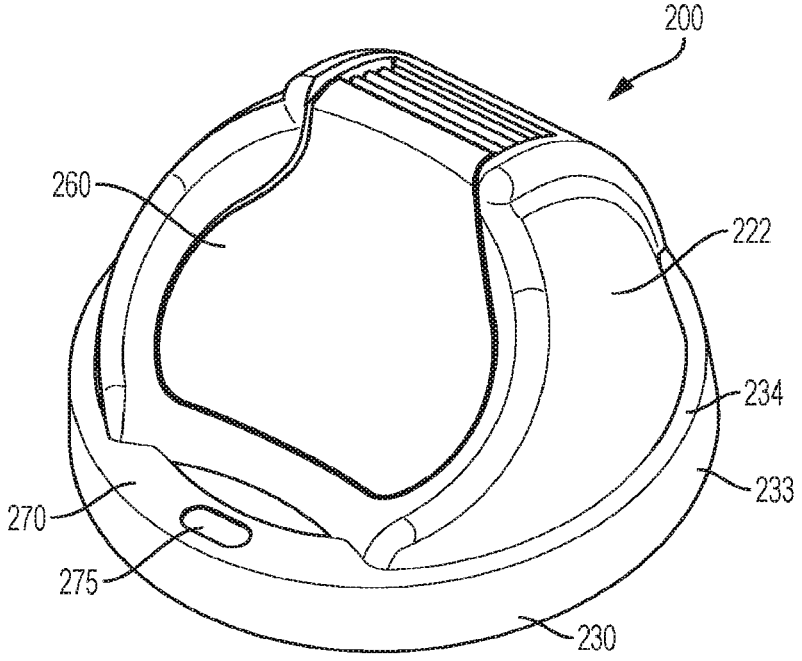
FIG. 15 is a perspective view of an alternate embodiment of an aroma enhancing beverage container lid having separate aroma and drink apertures and an automatic closure member.

In other embodiments, the selectively releasable closure member can be an automatic closure member 260 shaped and sized to closely match the dimensions of the aroma aperture 225, as shown in FIG. 15. The automatic closure member 260 can have a first end disposed at a height near the drink aperture 275 and a second end connected to a portion of the canopy 222 at another height above the first end by a hinge (not shown) or other mechanical fastener, such as a clip, pin, or other rotatable connection means known in the art. A spring or similar tensioning device can be used to exert spring force on the closure member 260 to bias the closure member 260 toward a rest position wherein the closure member 260 closes the aroma aperture 225 as shown in FIG. 15. Alternatively, the closure member 260 can be balanced such that gravity is the force which biases the closure member 260 toward the rest position. The automatic closure member 260 can be activated to open the aroma aperture 225 by pushing the closure member 260 though the aroma aperture 225 toward the interior space with a finger or the nose of the user, for example, when a user begins to drink through the lid 200. Upon the application of light pressure by the user, the automatic closure member 260 can swing through the aroma aperture 225 to allow the nose of the user to enter the interior space defined by the canopy 222. When the light pressure is removed, the closure member 260 can automatically swing back into its rest position to close the aroma aperture 225 as shown in FIG. 15.

Figure 16A:
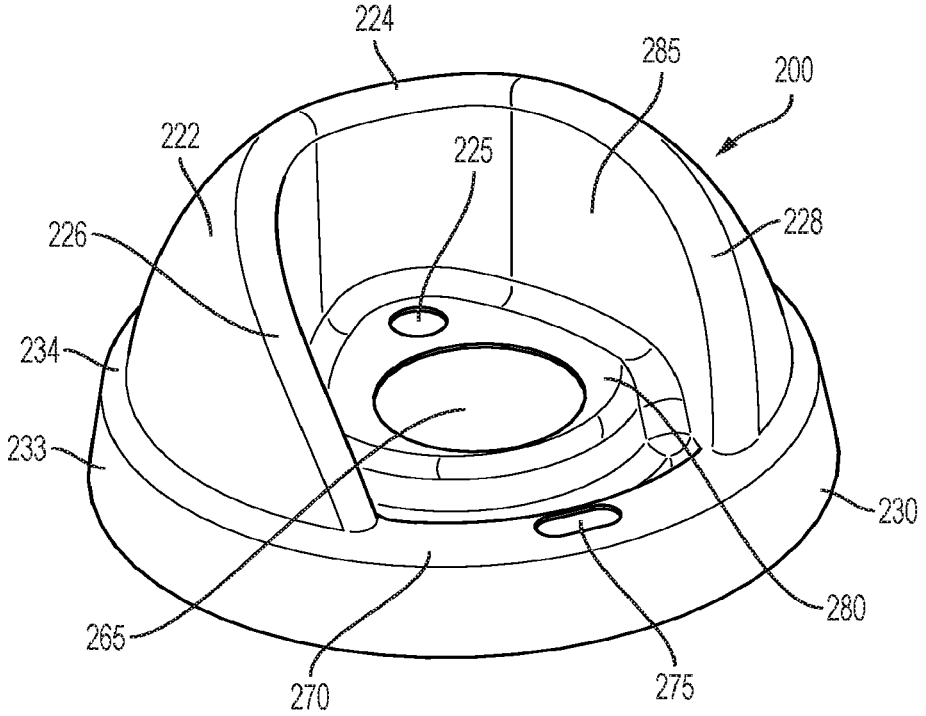
FIG. 16A is a perspective view of an embodiment of an aroma enhancing beverage container lid having separate aroma and drink apertures.
Figure 16B:
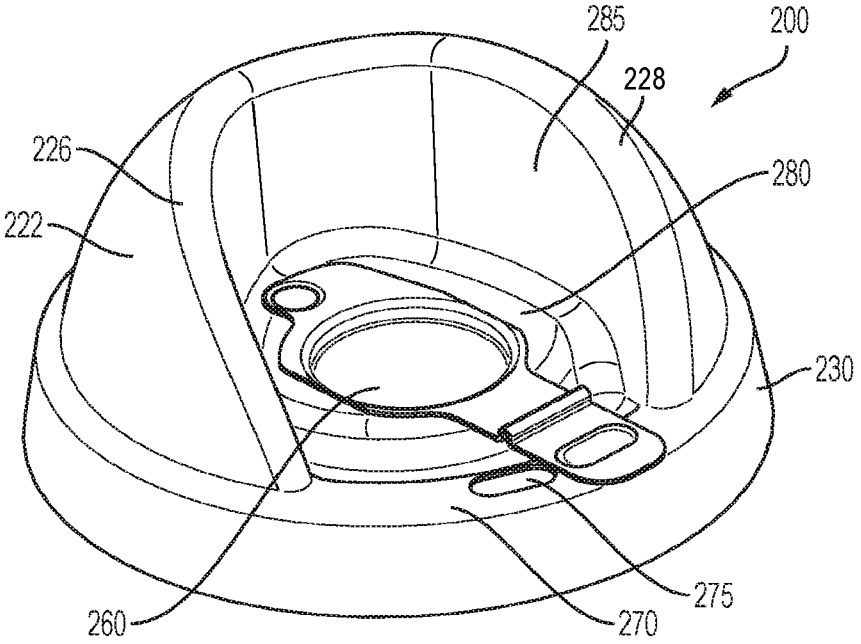
FIG. 16B shows the lid of FIG. 16A with a selectively releasable closure member in an open position.
Figure 16C:
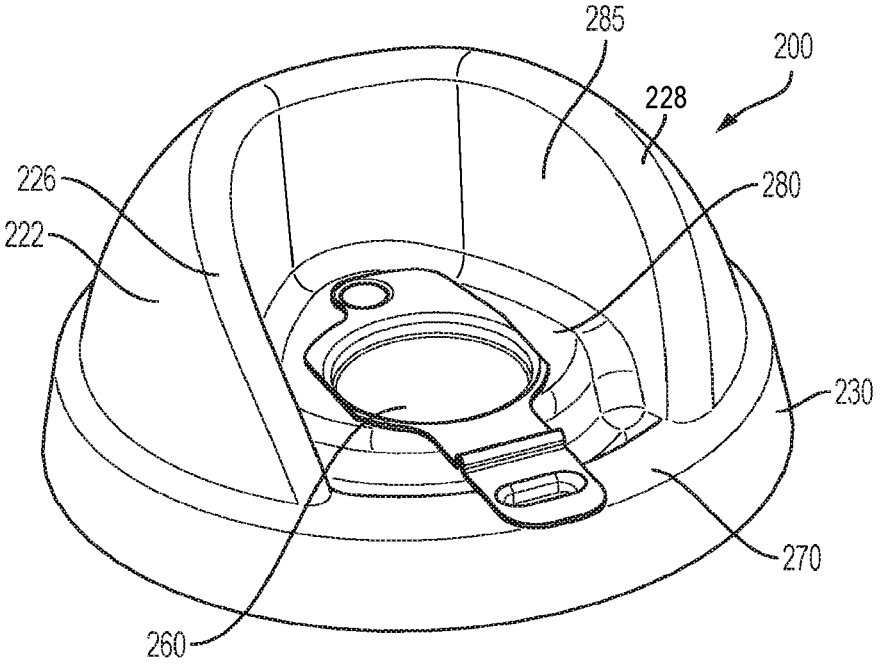
FIG. 16C shows the lid of FIG. 16B with the selectively releasable closure member in a closed position.

In still yet other embodiments, the selectively releasable closure member can be a flexible two stage closure member 260 as shown in FIGS. 16A-16C. A two-stage closure member 260 can be configured to simultaneously close both an aroma aperture 225 and a drink aperture 275. The two-stage closure member 260 can be connected to the lid 200 at the planar bottom face 280 by a mechanical fastener or by a downwardly extending central lobe configured to releasably engage a hole 265 defined through the planar bottom face 280. When connected to the lid 200, the two-stage closure member 260 can be selectably rotatable around the mechanical fastener or downwardly extending central lobe between a first position wherein the member 260 plugs the aroma and drink apertures 225, 275 (as shown in FIG. 16C), and a second position wherein the member 260 does not plug the aroma and drink apertures 225, 275 (as shown in FIG. 16B). Notably, the closure member 260 can include second and third downwardly extending lobes sized and shaped to plug the aroma aperture 225 and the drink aperture 275, respectively, when the second and third lobes are disposed in the aroma aperture 225 and drink aperture 275 at the first position as show in FIG. 16C. However, when the second lobe is in the second position as shown in FIG. 16B, the lobe causes a portion of the closure member 260 to flex and elevate the closure member above the surface of the planar bottom face 280 so that aroma vapors contained within a beverage container can escape through the aroma aperture 225. When the closure member 260 is in the second position and a user drinks a beverage though the drink aperture 275, the canopy sidewall 285 will cover a portion of the nose of the user and focus the aroma vapors into the nose.

The aroma enhancing beverage containers 300 and beverage container lids 200, 400 disclosed herein can be formed from any durable and suitably rigid material, including without limitation ceramic, plastic, stonewear, and metal.

Thus, although there have been described particular embodiments of the present invention of new and useful AROMA ENHANCING BEVERAGE CONTAINERS AND LIDS, it is not intended that such references be construed as limitation upon the scope of the invention.

What is claimed is:

1. A lid for enhancing the aroma of a liquid foodstuff contained in a beverage container, the lid comprising:

a mounting portion configured to releasably engage an opening of the beverage container;

a canopy extending generally upwardly from the mounting portion; and an aroma aperture defined through a portion of the canopy, the aperture sized and shaped to receive the nose of a user when the mounting portion is engaged with the opening of the beverage container and the user drinks a liquid foodstuff contained in the beverage container through the lid.

2. The lid of claim 1, wherein the opening of the beverage container is defined by a rim.

3. The lid of claim 1, wherein the canopy is upwardly convex.

4. The lid of claim 1, wherein the mounting portion is annular.

5. The lid of claim 1, wherein the canopy is configured to cover a portion of the nose and direct aroma vapors evolved from the foodstuff to the nose when the nose is received in the aroma aperture.

6. The lid of claim 1, wherein the aroma aperture is defined by a bottom edge and first and second laterally opposed edges, the bottom edge extending circumferentially along an arc of the canopy at a first canopy height above the mounting portion, said arc extending from a first lip position to a second lip position spaced an arc length around the canopy from the first lip position, the first laterally opposed edge extending upwardly along a curvature of the canopy from the first lip position to a vertex at a second canopy height above the first canopy height, the second laterally opposed edge extending upwardly along a curvature of the canopy from the second lip position to the vertex.

7. The lid of claim 6, further comprising:

an inwardly protruding ledge for receiving the lips of the user, the ledge extending circumferentially along the bottom edge of the aroma aperture; and a drink aperture defined through a portion of the ledge, wherein the drink aperture is smaller than the aroma aperture;

wherein the lips of a user engage the ledge and the nose of a user extends into the aroma aperture when the user drinks the foodstuff through the drink aperture.

8. The lid of claim 6, wherein the portion of the canopy through which the aroma aperture is defined comprises a segment of the canopy defined by an angle subtended by said arc from the apex of the canopy.

9. The lid of claim 8, wherein the apex of the canopy is positioned distal to a longitudinal axis extending through the geometric center of a circle defined by the mounting portion.

10. The lid of claim 9, wherein the apex is located closer to a side of the mounting portion located opposite the bottom edge of the aroma aperture.

11. The lid of claim 1, further comprising a utensil anchor defined though a portion of the canopy adjacent to the aroma aperture, the utensil anchor configured to receive a utensil for the preparation of liquid foodstuffs.

12. The lid of claim 11, wherein the utensil anchor is a slot defined through the portion of the canopy, the slot extending circumferentially around the portion of the canopy from an edge of the aroma aperture to a location spaced a distance around a circumference of the canopy from said edge.

13. The lid of claim 12, wherein the portion of the canopy through which the utensil anchor is defined is located above the mounting portion.

14. The lid of claim 2, wherein the mounting portion comprises a skirt having an internal flange, the skirt adapted to fit over the beverage container opening such that an internal surface of the skirt frictionally engages the exterior surface of the rim of the beverage container and the internal flange frictionally engages an upper surface of the rim.

15. The lid of claim 2, wherein the mounting portion is configured to fit over the beverage container opening and sealingly engage the rim of the beverage container.

16. The lid of claim 1, further comprising:

a closure member; and means for coupling the closure member to the canopy;

wherein the closure member is selectably rotatable about a longitudinal axis extending through the canopy from a first position wherein the closure member covers the aroma aperture, to a second position where in the closure member does not cover the aroma aperture.

17. A lid for enhancing the aroma of a liquid foodstuff contained in a beverage container, the lid comprising:

a mounting portion configured to releasably engage an opening of the beverage container;

a canopy extending generally upwardly from the mounting portion; and an aroma aperture defined through a portion of each of the canopy and the mounting portion, the aperture sized and shaped to receive the nose of a user when the mounting portion is engaged with the opening of the beverage container and the user drinks a liquid foodstuff contained in the beverage container through the aroma aperture.

18. The lid of claim 17, wherein the portion of the mounting portion through which the aroma aperture is defined comprises an arc of the mounting portion extending from a first rim position to a second rim position spaced from about 16% to about 50% around a perimeter of the mounting portion from the first rim position.

19. The lid of claim 18, wherein the arc extends from a first rim position to a second rim position spaced from about $\pi/6$ radians(30°) to about $\pi$ radians(180°) around a circumference of the mounting portion from the first rim position.

20. The lid of claim 18, wherein the portion of the canopy through which the aroma aperture is defined comprises a segment of the canopy defined by an angle subtended by said arc from an apex of the canopy.

* * * * *